US005612712A

United States Patent [19]

Kumar et al.

[11] Patent Number: 5,612,712

[45] Date of Patent: Mar. 18, 1997

[54] DIODE STRUCTURE FLAT PANEL DISPLAY

[75] Inventors: Nalin Kumar, Austin; Chenggang Xie, Cedar Park, both of Tex.

[73] Assignee: Microelectronics and Computer Technology Corporation, Austin, Tex.

[21] Appl. No.: 479,270

[22] Filed: Jun. 7, 1995

Related U.S. Application Data

[60] Division of Ser. No. 995,846, Dec. 23, 1992, Pat. No. 5,449,970, which is a continuation-in-part of Ser. No. 851, 701, Mar. 16, 1992, abandoned.

[51] Int. Cl.[6] ..... G09G 3/22

[52] U.S. Cl. ..... 345/75; 313/495

[58] Field of Search ..... 345/63, 74, 75, 345/77, 89, 147, 148; 313/495

[56] References Cited

U.S. PATENT DOCUMENTS

| | | |
|---|---|---|
| 1,954,691 | 4/1934 | de Boer et al. . |
| 2,851,408 | 9/1958 | Cerulli et al. . |
| 2,867,541 | 1/1959 | Coghill et al. . |
| 2,959,483 | 11/1960 | Kaplan . |
| 3,070,441 | 12/1962 | Schwartz . |
| 3,108,904 | 10/1963 | Cusano . |
| 3,259,782 | 7/1966 | Shroff . |
| 3,314,871 | 4/1967 | Heck et al. . |
| 3,360,450 | 12/1967 | Hays . |
| 3,481,733 | 12/1969 | Evans . |
| 3,525,679 | 8/1970 | Wilcox et al. . |
| 3,554,889 | 1/1971 | Hyman et al. . |
| 3,665,241 | 5/1972 | Spindt et al. . |
| 3,675,063 | 7/1972 | Spindt et al. . |
| 3,755,704 | 8/1973 | Spindt et al . |
| 3,789,471 | 2/1974 | Spindt et al. . |
| 3,808,048 | 4/1974 | Strik . |

(List continued on next page.)

FOREIGN PATENT DOCUMENTS

| | | |
|---|---|---|
| 8807288 | 12/1989 | France . |
| 57-141480 | 9/1982 | Japan . |
| 57-141482 | 9/1982 | Japan . |
| 58-102444 | 6/1983 | Japan . |
| 58-164133 | 9/1983 | Japan . |

(List continued on next page.)

OTHER PUBLICATIONS

"A new vacuum–etched high–transmittance (antireflection) film," *Appl. Phys. Lett.*, 1980, pp. 727–730.

"A Silicon Field Emitter Array Planar Vacuum FET Fabricated with Microfabrication Techniques," *Mat. Res. Soc. Symp. Proc.*, vol. 76, 1987, pp. 25–30.

"A Technique for Controllable Seeding of Ultrafine Diamond Particles for Growth and Selective–Area Deposition of Diamond Films," *2nd International Conference on the Applications of Diamond Films and Related Materials*, 1993, pp. 475–480.

"Computer Simulations in the Design of Ion Beam Deflection Systems," *Nuclear Instruments and Methods in Physics Research*, vol. B10, No. 11, 1985, pp. 817–821.

(List continued on next page.)

*Primary Examiner*—Jeffery Brier

*Attorney, Agent, or Firm*—Kelly K. Kordzik; Winstead Sechrest & Minick P.C.

[57] ABSTRACT

A matrix-addressed diode flat panel display of field emission type is described, utilizing a diode (two terminal) pixel structure. The flat panel display comprises a cathode assembly having a plurality of cathodes, each cathode including a layer of cathode conductive material and a layer of a low effective work-function material deposited over the cathode conductive material and an anode assembly having a plurality of anodes, each anode including a layer of anode conductive material and a layer of cathodoluminescent material deposited over the anode conductive material, the anode assembly located proximate the cathode assembly to thereby receive charged particle emissions from the cathode assembly, the cathodoluminescent material emitting light in response to the charged particle emissions. The flat panel display further comprises means for selectively varying field emission between the plurality of corresponding light-emitting anodes and field-emission cathodes to thereby effect an addressable grey-scale operation of the flat panel display.

47 Claims, 5 Drawing Sheets

U.S. PATENT DOCUMENTS

| | | | |
|---|---|---|---|
| 3,812,559 | 5/1974 | Spindt et al. . | |
| 3,855,499 | 12/1974 | Yamada et al. . | |
| 3,872,352 | 3/1975 | Sasaki et al. | 345/74 |
| 3,898,146 | 8/1975 | Rehkopf et al. . | |
| 3,947,716 | 3/1976 | Fraser, Jr. et al. . | |
| 3,970,887 | 7/1976 | Smith et al. . | |
| 3,998,678 | 12/1976 | Fukase et al. . | |
| 4,008,412 | 7/1977 | Yuito et al. . | |
| 4,075,535 | 2/1978 | Genequand et al. . | |
| 4,084,942 | 4/1978 | Villalobos . | |
| 4,139,773 | 2/1979 | Swanson . | |
| 4,141,405 | 2/1979 | Spindt . | |
| 4,143,292 | 3/1979 | Hosoki et al. . | |
| 4,164,680 | 8/1979 | Villalobos . | |
| 4,168,213 | 9/1979 | Hoeberechts . | |
| 4,178,531 | 12/1979 | Alig . | |
| 4,307,507 | 12/1981 | Gray et al. . | |
| 4,350,926 | 9/1982 | Shelton . | |
| 4,459,514 | 7/1984 | Morimoto et al. | 345/75 |
| 4,482,447 | 11/1984 | Mizuguchi et al. . | |
| 4,498,952 | 2/1985 | Christensen . | |
| 4,507,562 | 3/1985 | Braunlich et al. . | |
| 4,512,912 | 4/1985 | Matsuda et al. . | |
| 4,513,308 | 4/1985 | Greene et al. . | |
| 4,540,983 | 9/1985 | Morimoto et al. . | |
| 4,542,038 | 9/1985 | Odaka et al. . | |
| 4,578,614 | 3/1986 | Gray et al. . | |
| 4,588,921 | 5/1986 | Tischer . | |
| 4,594,527 | 6/1986 | Genevese . | |
| 4,633,131 | 12/1986 | Khurgin . | |
| 4,647,400 | 3/1987 | Dubroca et al. . | |
| 4,663,559 | 5/1987 | Christensen . | |
| 4,684,353 | 8/1987 | deSouza . | |
| 4,684,540 | 8/1987 | Schulze . | |
| 4,685,996 | 8/1987 | Busta et al. . | |
| 4,687,825 | 8/1987 | Sagou et al. . | |
| 4,687,938 | 8/1987 | Tamura et al. . | |
| 4,710,765 | 12/1987 | Ohkoshi et al. . | |
| 4,721,885 | 1/1988 | Brodie . | |
| 4,728,851 | 3/1988 | Lambe . | |
| 4,758,449 | 7/1988 | Kimura et al. . | |
| 4,763,187 | 8/1988 | Biberian . | |
| 4,780,684 | 10/1988 | Kosmahl . | |
| 4,788,472 | 11/1988 | Katakami . | |
| 4,816,717 | 3/1989 | Harper et al. . | |
| 4,818,914 | 4/1989 | Brodie . | |
| 4,822,466 | 4/1989 | Rabalais et al. . | |
| 4,827,177 | 5/1989 | Lee et al. . | |
| 4,835,438 | 5/1989 | Baptist et al. . | |
| 4,851,254 | 7/1989 | Yamamoto et al. . | |
| 4,855,636 | 8/1989 | Busta et al. . | |
| 4,857,161 | 8/1989 | Borel et al. . | |
| 4,857,799 | 8/1989 | Spindt et al. . | |
| 4,874,981 | 10/1989 | Spindt . | |
| 4,882,659 | 11/1989 | Gloudemans . | |
| 4,889,690 | 12/1989 | Lubbers et al. . | |
| 4,892,757 | 1/1990 | Kasenga et al. . | |
| 4,899,081 | 2/1990 | Kishino et al. . | |
| 4,900,584 | 2/1990 | Tuenge et al. . | |
| 4,908,539 | 3/1990 | Meyer . | |
| 4,923,421 | 5/1990 | Brodie et al. . | |
| 4,926,056 | 5/1990 | Spindt . | |
| 4,933,108 | 6/1990 | Soredal . | |
| 4,940,916 | 7/1990 | Borel et al. . | |
| 4,943,343 | 7/1990 | Bardai et al. . | |
| 4,956,202 | 9/1990 | Kasenga et al. . | |
| 4,956,573 | 9/1990 | Kane . | |
| 4,964,946 | 10/1990 | Gray et al. . | |
| 4,987,007 | 1/1991 | Wagal et al. . | |
| 4,990,416 | 2/1991 | Mooney . | |
| 4,990,766 | 2/1991 | Simms et al. . | |
| 4,994,205 | 2/1991 | Towers . | |
| 5,007,873 | 4/1991 | Goronkin et al. . | |
| 5,008,657 | 4/1991 | Hansen et al. | 345/208 |
| 5,015,912 | 5/1991 | Spindt et al. . | |
| 5,019,003 | 5/1991 | Chason . | |
| 5,036,247 | 7/1991 | Watanabe et al. . | |
| 5,038,070 | 8/1991 | Bardai et al. . | |
| 5,043,715 | 8/1991 | Kun et al. . | |
| 5,054,046 | 10/1991 | Shoulders . | |
| 5,054,047 | 10/1991 | Shoulders . | |
| 5,055,077 | 10/1991 | Kane . | |
| 5,055,744 | 10/1991 | Tsuruoka . | |
| 5,057,047 | 10/1991 | Greene et al. . | |
| 5,063,323 | 11/1991 | Longo et al. . | |
| 5,063,327 | 11/1991 | Brodie et al. . | |
| 5,064,396 | 11/1991 | Spindt . | |
| 5,066,883 | 11/1991 | Yoshioka et al. . | |
| 5,075,591 | 12/1991 | Holmberg . | |
| 5,075,595 | 12/1991 | Kane . | |
| 5,075,596 | 12/1991 | Young et al. . | |
| 5,079,476 | 1/1992 | Kane . | |
| 5,085,958 | 2/1992 | Jeong . | |
| 5,089,292 | 2/1992 | MaCaulay et al. . | |
| 5,089,742 | 2/1992 | Kirkpatrick et al. . | |
| 5,089,812 | 2/1992 | Fuse . | |
| 5,090,932 | 2/1992 | Dieumegard et al. . | |
| 5,098,737 | 3/1992 | Collins et al. . | |
| 5,101,137 | 3/1992 | Kun et al. . | |
| 5,101,288 | 3/1992 | Ohta et al. . | |
| 5,103,144 | 4/1992 | Dunham . | |
| 5,103,145 | 4/1992 | Doran . | |
| 5,117,267 | 5/1992 | Kimoto et al. . | |
| 5,117,299 | 5/1992 | Kondo et al. . | |
| 5,119,386 | 6/1992 | Narusawa . | |
| 5,123,039 | 6/1992 | Shoulders . | |
| 5,124,072 | 6/1992 | Dole et al. . | |
| 5,124,558 | 6/1992 | Soltani et al. . | |
| 5,126,287 | 6/1992 | Jones . | |
| 5,129,850 | 7/1992 | Kane et al. . | |
| 5,132,585 | 7/1992 | Kane et al. . | |
| 5,132,676 | 7/1992 | Kimura et al. . | |
| 5,136,764 | 8/1992 | Vasquez . | |
| 5,138,237 | 8/1992 | Kane et al. . | |
| 5,140,219 | 8/1992 | Kane . | |
| 5,141,459 | 8/1992 | Zimmerman . | |
| 5,141,460 | 8/1992 | Jaskie et al. . | |
| 5,142,184 | 8/1992 | Kane . | |
| 5,142,256 | 8/1992 | Kane . | |
| 5,142,390 | 8/1992 | Ohta et al. . | |
| 5,144,191 | 9/1992 | Jones et al. . | |
| 5,146,213 | 9/1992 | Brunel et al. | 345/77 |
| 5,148,078 | 9/1992 | Kane . | |
| 5,148,461 | 9/1992 | Shoulders . | |
| 5,150,011 | 9/1992 | Fujieda . | |
| 5,150,192 | 9/1992 | Greene et al. . | |
| 5,151,061 | 9/1992 | Sandhu . | |
| 5,153,753 | 10/1992 | Ohta et al. . | |
| 5,153,901 | 10/1992 | Shoulders . | |
| 5,155,420 | 10/1992 | Smith . | |
| 5,156,770 | 10/1992 | Wetzel et al. . | |
| 5,157,304 | 10/1992 | Kane et al. . | |
| 5,157,309 | 10/1992 | Parker et al. . | |
| 5,157,524 | 10/1992 | Dijon et al. | 345/89 |
| 5,162,704 | 11/1992 | Kobori et al. . | |
| 5,166,456 | 11/1992 | Masahiko . | |
| 5,173,634 | 12/1992 | Kane . | |
| 5,173,635 | 12/1992 | Kane . | |
| 5,173,697 | 12/1992 | Smith et al. . | |
| 5,180,951 | 1/1993 | Dworsky et al. . | |
| 5,183,529 | 2/1993 | Potter et al. . | |
| 5,185,178 | 2/1993 | Koskenmaki . | |

5,186,670 2/1993 Doan et al. .
5,187,578 2/1993 Kohgami et al. .
5,191,217 3/1993 Kane et al. .
5,192,240 3/1993 Komatsu .
5,194,780 3/1993 Meyer .
5,199,917 4/1993 MacDonald et al. .
5,199,918 4/1993 Kumar .
5,201,992 4/1993 Marcus et al. .
5,202,571 4/1993 Hinabayashi et al. .
5,203,731 4/1993 Zimmerman .
5,204,021 4/1993 Dole .
5,204,581 4/1993 Andreadakis et al. .
5,205,770 4/1993 Lowrey et al. .
5,209,687 5/1993 Konishi .
5,210,430 5/1993 Taniguchi et al. .
5,210,462 5/1993 Konishi .
5,212,426 5/1993 Kane .
5,213,712 5/1993 Dole .
5,214,346 5/1993 Komatsu .
5,214,347 5/1993 Gray .
5,214,416 5/1993 Kondo et al. .
5,220,725 6/1993 Chan et al. .
5,227,699 7/1993 Busta .
5,228,877 7/1993 Allaway et al. .
5,228,878 7/1993 Komatsu .
5,229,331 7/1993 Doan et al. .
5,229,682 7/1993 Komatsu .
5,231,606 7/1993 Gray .
5,232,549 8/1993 Cathey et al. .
5,233,263 8/1993 Cronin et al. .
5,235,244 8/1993 Spindt .
5,236,545 8/1993 Pryor .
5,242,620 9/1993 Dole et al. .
5,243,252 9/1993 Kaneko et al. .
5,250,451 10/1993 Chouan .
5,252,833 10/1993 Kane et al. .
5,256,888 10/1993 Kane .
5,259,799 11/1993 Doan et al. .
5,262,698 11/1993 Dunham .
5,266,155 11/1993 Gray .
5,275,967 1/1994 Taniguchi et al. .
5,276,521 1/1994 Mori et al. .
5,277,638 1/1994 Lee .
5,278,475 1/1994 Jaskie et al. .
5,281,890 1/1994 Kane .
5,281,891 1/1994 Kaneko et al. .
5,283,500 2/1994 Kochanski .
5,285,129 2/1994 Takeda et al. .
5,296,117 3/1994 De Jaeger et al. .
5,300,862 4/1994 Parker et al. .
5,302,423 4/1994 Tran et al. .
5,308,439 5/1994 Cronin et al. .
5,312,514 5/1994 Kumar .
5,312,777 5/1994 Cronin et al. .
5,315,393 5/1994 Mican .
5,329,207 7/1994 Cathey et al. .
5,330,879 7/1994 Dennison .
5,341,063 8/1994 Kumar .
5,347,201 9/1994 Liang et al. .
5,347,292 9/1994 Ge et al. .
5,357,172 10/1994 Lee et al. .
5,368,681 11/1994 Hiraoka et al. .
5,378,963 1/1995 Ikeda .
5,380,546 1/1995 Kirshnan et al. .
5,387,844 2/1995 Browning .
5,393,647 2/1995 Neukermans et al. .
5,396,150 3/1995 Wu et al. .
5,399,238 3/1995 Kumar .
5,401,676 3/1995 Lee .
5,402,041 3/1995 Kishino et al. .
5,404,070 4/1995 Tsai et al. .
5,404,074 4/1995 Watanabe et al. ..... 345/74
5,408,161 4/1995 Kishino et al. .
5,410,218 4/1995 Hush .
5,412,285 5/1995 Komatsu .

FOREIGN PATENT DOCUMENTS 59-075547 4/1984 Japan .
59-075548 4/1984 Japan .
59-209249 11/1984 Japan .
60-009039 1/1985 Japan .
60-049553 3/1985 Japan .
60-115682 6/1985 Japan .
62-027486 2/1987 Japan .
62-121783 6/1987 Japan .
63-251491 10/1988 Japan .
64-043595 2/1989 Japan .
3-127431 5/1991 Japan .
3-119640 5/1991 Japan .
3-137190 6/1991 Japan .
4-202493 7/1992 Japan .
4-227678 8/1992 Japan .
4-227785 8/1992 Japan .
4-233991 8/1992 Japan .
4-230996 8/1992 Japan .
4-270783 9/1992 Japan .
5-065478 3/1993 Japan .
5-117653 5/1993 Japan .
5-117655 5/1993 Japan .

OTHER PUBLICATIONS

"Cone formation as a result of whisker growth on ion bombarded metal surfaces," *J. Vac. Sci. Technol. A,* vol. 3, No. 4, Jul./Aug. 1985, pp. 1821–1834.

"Cone Formation on Metal Targets During Sputtering," *J. Appl. Physics,* vol. 42, No. 3, Mar. 1, 1971, pp. 1145–1149.

"Control of silicon field emitter shape with isotrophically etched oxide masks," *Inst. Phys. Conf. Ser. No. 99: Section 2,* Presented at *2nd Int. Conf. on Vac. Microelectron.,* Bath, 1989, pp. 37–40.

"Deposition of diamond–like carbon," *Phil. Trans. R. Soc. Land. A,* vol. 342, 1993, pp. 277–286.

"Fabrication of encapsulated silicon–vacuum field–emission transistors and diodes", *J. Vac. Sci. Technol. B,* vol. 10, No. 6, Nov./Dec. 1992, pp. 2984–2988.

"Fabrication of gated silicon field–emission cathodes for vacuum microelectronics and electro–beam applications," *J. Vac. Sci. Technol. B,* vol. 11, No. 2, Mar./Apr. 1993, pp. 454–458.

"Fabrication of silicon field emission points for vacuum microelectronics by wet chemical etching," *Semicond. Sci. Technol.,* vol. 6, 1991, pp. 223–225.

"Fabrication of 0.4 μm grid apertures for field–emission array cathodes," *Microelectronic Engineering,* vol. 21, 1993, pp. 467–470.

"Growth of diamond particles on sharpened silicon tips," *Materials Letters,* vol. 18, No. 1.2, 1993, pp. 61–63.

"Interference and diffraction in globular metal films," *J. Opt. Soc. Am.,* vol. 68, No. 8, Aug. 1978, pp. 1023–1031.

"Oxidation sharpening of silicon tips," *J. Vac. Sci. Technol. B,* vol. 9, No. 6, Nov./Dec. 1991, pp. 2733–2737.

"Physical properties of thin film field emission cathodes with molybdenum cones," *Journal of Applied Physics,* vol. 47, No. 12, 1976, pp. 5248–5263.

"Recent Progress in Low–Voltage Field–Emission Cathode Development," *Journal de Physique,* Colloque C9, supp. au No. 12, Tome 45, Dec. 12984, pp. C9–269–278.

"The influence of surface treatment on field emission from silicon microemitters," *J. Phys.: Condens. Matter,* vol. 3, 1991, pp. S231–S236.

"Topography: Texturing Effects," *Handbook of Ion Beam Processing Technology,* Chapter 17, pp. 338–361.

"Ultrasharp tips for field emission applications prepared by the vapor–liquid–solid growth technique," *J. Vac. Sci. Technol. B,* vol. 11, No. 2, Mar./Apr. 1993, pp. 449–453.

"A Comparative Study of Deposition of Thin Films by Laser Induced PVD with Femtosecond and Nanosecond Laser Pulses," *SPIE,* vol. 1858, 1993, pp. 464–475.

"Amorphic diamond films produced by a laser plasma source," *J. Appl. Physics,* vol. 67, No. 4, Feb. 15, 1990, pp. 2081–2087.

"Characterization of laser vaporization plasmas generated for the deposition of diamond–like carbon," *J. Appl. Phys.,* vol. 72, No. 9, Nov. 1, 1992, pp. 3966–3970.

"Cold Field Emission From CVD Diamond Films Observed in Emission Electron Microscopy," Dept. of Physics & Astronomy & the Condensed Matter & Surface Science Program, Ohio University, Athens, Ohio, Jun. 10, 1991.

"Current Display Research—A Survey," Zenith Radio Corporation.

"Deposition of Amorphous Carbon Films from Laser–Produced Plasmas," *Mat. Res. Soc. Sump. Proc.,* vol. 38, 1985, pp. 326–335.

"Development of Nano–Crystaline Diamond–Based Field–Emission Displays," *SID 94Digest,* 1994, pp. 43–45.

"Diamond Cold Cathode," *IEEE Electron Device Letters,* vol. 12, No. 8, Aug. 1991, pp. 456–459.

"Diamond–like carbon films prepared with a laser ion source," *Appl. Phys. Lett.,* vol. 53, No. 3, 18 Jul. 1988, pp. 187–188.

"Direct Observation of Laser–Induced Crystallization of a–C:H Films," *Appl. Phys. A,* vol. 58, 1994, pp. 137–144.

"Emission spectroscopy during excimer laser ablation of graphite," *Appl. Phys. Letters,* vol. 57, No. 21, 19 Nov. 1990, pp. 2178–2180.

"Enhanced cold–cathode emission using composite resin–carbon coatings," Dept. of Electronic Eng. & Applied Physics, Aston Univ., Aston Triangle, Birmingham, UK, 29 May 1987.

"High Temperature Chemistry in Laser Plumes," *John L. Margrave Research Symposium,* Rice University, Apr. 29, 1994.

"Imaging and Characterization of Plasma Plumes Produced During Laser Ablation of Zirconium Carbide," D. P. Butt and P. J. Wantuck, *Materials Research Society Symposium Proceedings,* vol. 285, pp. 81–86 (*Laser Ablation in Materials Processing: Fundamentals and Applications*—symposium held Dec. 1–4, 1992, Boston, Mass.).

"Laser–Assisted Selective Area Metallization of Diamond Surface by Electroless Nickel Plating," *2nd International Conference on the Applications of Diamond Films and Related Materials,* 1993, pp. 303–306.

"Laser plasma source of amorphic diamond," *Appl. Phys. Lett.,* vol. 54, No. 3, Jan. 16, 1989, pp. 216–218.

"Optical characterization of thin film laser deposition processes," *SPIE,* vol. 1594, *Process Module Metrology, Control, and Clustering,* 1991, pp. 411–417.

"Optical Emission Diagnostics of Laser–Induced Plasma for Diamond–like Film Deposition," *Applied Physics A—Solids and Surfaces,* vol. 52, 1991, pp. 328–334.

"Optical observation of plumes formed at laser ablation of carbon materials," *Applied Surface Science,* vol. 79/80, 1994, pp. 141–145.

"Spatial characteristics of laser pulsed plasma deposition of thin films," *SPIE,* vol. 1352, *Laser Surface Microprocessing,* 1989, pp. 95–99.

"Species Temporal and Spatial Distributions in Laser Ablation Plumes," J.W. Hastie, et al., *Materials Research Society Symposium Proceedings,* vol. 285, pp. 39–44 (*Laser Ablation in Materials Processing: Fundamentals and Applications*—symposium held Dec. 1–4, 1992, Boston, Mass.).

"The bonding of protective films of amorphic diamond to titanium," *J. Appl. Phys.,* vol. 71, No. 7, 1 Apr. 1992, pp. 3260–3265.

"Thermochemistry of materials by laser varporization mass spectrometry: 2. Graphite," *High Temperatures—High Pressures,* vol. 20, 1988, pp. 73–89.

"A Comparison of the Transmission Coefficient and the Wigner Function Approaches to Field Emission," *COMPEL,* vol. 11, No. 4, 1992, pp. 457–470.

"A New Model for the Replacement Process in Electron Emission at High Fields and Temperatures," Dept. of Physics, The Penn. State Univ., University Park, PA.

"Angle–resolved photoemission of diamond (111) and (100) surfaces; negative electron affinity and band structure measurements," *J. Vac. Sci. Technol. B,* vol. 12, No. 4, Jul./Aug. 1994, pp. 2475–2479.

"Angular Characteristics of the Radiation by Ultra Relativistic Electrons in Thick Diamond Single Crystals," *Sov. Tech. Phys. Lett.,* vol. 11, No. 11, Nov. 1985, pp. 574–575.

"Argon and hydrogen plasma interactions on diamond (111) surfaces: Electronic states and structure," *Appl. Phys. Lett.,* vol. 62, No. 16, 19 Apr. 1993, pp. 1878–1880.

"A Theoretical Study on Field Emission Array for Microsensors," *IEEE Transactions on Electron Devices,* vol. 39, No. 2, Feb. 1992, pp. 313–324.

"A Wide–Bandwidth High–Gain Small–Size Distributed Amplifier with Field–Emission Triodes (FETRODE's) for the 10 to 300 GHz Frequency Range," *IEEE Transactions on Electron Devices,* vol. 36, No. 11, Nov. 1989, pp. 2728–2737.

"Capacitance–Voltage Measurements on Metal–$SiO_2$–Diamond Structures Fabricated with (100)–and (111)–Oriented Substrates," *IEEE Transactions on Electroc Devices,* vol. 38, No. 3, Mar. 1991, pp. 619–626.

"Characterisation of the Field Emitting Properties of CVD Diamond Films," *Conference Record—1994 Tri–Service/NASA Cathode Workshop,* Cleveland, Ohio, Mar. 29–31, 1994, pp. 91–94.

"Collector–Assisted Operation of Micromachined Field–Emitter Triodes," *IEEE Transactions on Electron Devices,* vol. 40, No. 8, Aug. 1993, pp. 1537–1542.

"Collector–Induced Field Emission Triode," *IEEE Transations on Electron Devices,* vol. 39, No. 11, Nov. 1992, pp. 2616–2620.

"Diamond–based field emission flat panel displays," *Solid State Technology,* May 1995, pp. 71–74.

"Diamond Field–Emission Cathodes," *Conference Record—1994 Tri–Service/NASA Cathode Workshop,* Cleveland, Ohio, Mar. 29–31, 1994.

"Diamond Field–Emission Cathode Technology," Lincoln Laboratory @MIT.

"Diamond–like nanocomposites (DLN)," *Thin Solid Films,* vol. 212, 1992, pp. 267–273.

"Diamond–like nanocomposites: electronic transport mechanisms and some applications," *Thin Solid Films,* vol. 212, 1992, pp. 274–281.

"Electrical characterization of gridded field emission arrays," *Inst. Phys. Conf. Ser. No. 99: Section 4* Presented at *2nd Int. Conf. on Vac. Microelectron.,* Bath, 1989, pp. 81–84.

"Electrical phenomena occurring at the surface of electrically stressed metal cathodes. II identification of electroluminescecent and breakdown phenomena with medium gap spacings (2–8 mm)," *J. Phys. D: Appl. Phys.,* vol. 12, 1979, pp. 2229–2245.

"Electrical phenomena occurring at the surface of electrically stressed metal cathodes. I. Electroluminesnce (k–spot) radiation with electron emission on broad area cathodes," *J. Phys. D: Appl. Phys.,* vol. 12, 1979, pp. 2247–2252.

"Electroluminescence produced by high electric fields at the surface of copper cathodes," *J. Phys. D: Appl. Phys.,* vol. 10, 1977, pp. L195–L201.

"Electron emission from phosphorus–and boron–doped polycrystalline diamond films," *Electronics Letters,* vol. 31, No. 1, Jan. 1995, pp. 74–75.

"Electron Field Emission from Amorphic Diamond Thin Films," *6th International Vacuum Microelectronics Conference Technical Digest,* 1993, pp. 162–163.

"Electron Field Emission from Broad–Area Electrodes," *Applied Physics A—Solids and Surfaces,* vol. 28, 1982, pp. 1–24.

"Emission characteristics of metal–oxide–semiconductor electron tunneling cathode," *J. Vac. Sci. Technol. B,* vol. 11, No. 2, Mar./Apr. 1993, pp. 429–432.

"Emission Characteristics of Silicon Vacuum Triodes with Four Different Gate Geometries," *IEEE Transactions on Electron Devices,* vol. 40, No. 8, Aug. 1993, pp. 1530–1536.

"Emission Properties of Spindt–Type Cold Cathodes with Different Emission Cone Material", *IEEE Transactions on Electron Devices,* vol. 38, No. 10, Oct. 1991.

"Energy exchange processes in field emission from atomically sharp metallic emitters," *J. Vac. Sci. Technol. B,* vol. 11, No. 2, Mar./Apr. 1993, pp. 366–370.

"Enhanced Cold–Cathode Emission Using Composite Resin–Carbon Coatings," Dept. of Electronic Eng. & Applied Phiscs, Aston Univ., Aston Triangle, Birmingham, UK, May 29, 1987.

"Experimental and theoretical determinations of gate–to–emitter stray capacitances of field emitters," *J. Vac. Sci. Technol. B.,* vol. 11, No. 2, Mar./Apr. 1993, pp. 445–448.

"Fabrication and Characterization of Lateral Field–Emitter Triodes," *IEEE Transactions on Electron Devices,* vol. 38, No. 10, Oct. 1991, pp. 2334–2336.

"Field–Dependence of the Area–Density of 'Cold' Electron Emission Sits on Broad–Area CVD Diamond Films," *Electronics Letters,* vol. 29, No. 18, 2 Sep. 1993, pp. 1596–1597.

"Field Electron Energy Distributions for Atomically Sharp Emitters," The Penn. State Univ., University Park, PA.

*Field Emission and Field Ionization,* "Theory of Field Emission" (Chapter 1) and Field–Emission Microscopy and Related Topics (Chapter 2), *Harvard Monographs in Applied Science,* No. 9, Harvard University Press, Cambridge, Mass., 1961, pp. 1–63.

"Field Emission Cathode Technology and It's [sic] Applications," *Technical Digest of IVMC 91,* Nagahama, 1991, pp. 40–43.

"Field Emission Characteristic Requirements for Field Emission Displays," *Conf. of 1994 Int. Display Research Conf. and Int. Workshops on Active–Matrix LCDs & Display Mat's,* Oct. 1994.

"Field emission device modeling for application to flat panel displays," *J. Vac. Sci. Technol. B1.,* vol. 11, No. 2, Mar./Apr. 1993, pp. 518–522.

"Field Emission Displays Based on Diamond Thin Films," *Society of Information Display Conference Technical Digest,* 1993, pp. 1009–1110.

"Field emission from silicon through an adsorbate layer," *J. Phys.: Condens. Matter,* vol. 3, 1991, pp. S187–S192.

"Field Emission from Tungsten–Clad Silicon Pyramids," *IEEE Transactions on Electron Devices,* vol. 36, No. 11, Nov. 1989, pp. 2679–2685.

"Field Emission Measurements with μm Resolution on CVD–Polycrystalline Diamond Films," To be published and presented at the *8th IVMC '95,* Portland, Oregon.

"Field–emitter–array development for high–frequency operation," *J. Vac. Sci. Technol. B,* vol. 11, No. 2, Mar./Apr. 1993, pp. 468–473.

"Field Emitter Arrays Applied to Vacuum Fluorescent Display," *Journal de Physique,* Colloque C6, supp. au No. 11, Tome 49, Nov. 1988, pp. C6–153–154.

"Field Emitter Arrays—More Than a Scientific Curiosity?" *Colloque de Physique,* Colloque C8, supp. au No. 11, Tome 50, Nov. 1989, pp. C8–67–72.

"Field Emitter Array with Lateral Wedges," *Technical Digest of IVMC 91,* Nagahama, 1991, pp. 50–51.

"Field emitter tips for vacuum microelectronic devices," *J. Vac. Sci. Technol. A,* vol. 8, No. 4, Jul./Aug. 1990, pp. 3586–3590.

"Field–induced electron emission through Langmuir–Blodgett multiplayers," Dept. of Electrical and Electronic Engineering and Applied Physics, Aston Univ., Birmingham, UK, Sep. 1987 (0022–3727/88/010148+06).

"Field–Induced Photoelectron Emission from p–Type Silicon Aluminum Surface–Barrier Diodes," *Journal of Applied Physics,* vol. 41, No. 5, Apr. 1970, pp. 1945–1951.

"Flat–Panel Displays," *Scientific American,* Mar. 1993, pp. 90–97.

"Gated Field Emitter Failures: Experiment and Theory," *IEEE Transactions on Plasma Science,* vol. 20, No. 5, Oct. 1992, pp. 499–506.

"High–resolution simulation of field emission," *Nuclear Instruments and Methods in Physics Research* A298, 1990, pp. 39–44.

"Ion–space–charge initiation of gated field emitter failure," *J. Vac. Sci Technol. B,* vol. 11, No. 2, Mar./Apr. 1993, pp. 441–444.

"Low–energy electron transmission and secondary–electron emission experiments on crystalline and molten long–chain alkanes," *Physical Review B,* vol. 34, No. 9, 1 Nov. 1986, pp. 6386–6393.

"Low Energy Electron Transmission Measurements on Polydiacetylene Langmuir–Blodgett Films," *Thin Solid Films,* vol. 179, 1989, pp. 327–334.

"Measurement of gated field emitter failures", *Rev. Sci. Instrum.,* vol. 64, No. 2, Feb. 1993, pp. 581–582.

"Metal–Film–Edge Emitter Array with a Self–Aligned Gate," *Technical Digest of IVMC 91,* Nagahama, 1991, pp. 46–47.

"Microstructural Gated Field Emission Sources for Electron Beam Applications," *SPIE,* vol. 1671, 1992, pp. 201–207.

"Microstructure of Amorphic Diamond Films," The Univ. of Texas at Dallas, Center for Quantum Electronics, Richardson, Texas.
"Microtip Field–Emission Display Performance Considerations," *SID 92 Digest,* pp. 523–526.
"Monoenergetic and Directed Electron Emission from a Large–Bandgap Organic Insulator with Negative Electron Affinity," *Europhysics Letters,* vol. 5, No. 4, 1988, pp. 375–380.
"Monte Carlo Simulation of Ballistic Charge Transport in Diamond under an Internal Electric Field," Dept. of Physics, The Penn. State Univ., University Park, PA, Mar. 3, 1995.
"Negative Electron Affinity and Low Work Function Surface: Cesium on Oxygenated Diamond (100)," *Physical Review Letters,* vol. 73, No. 12, 19 Sep. 1994, pp. 1664–1667.
"Numerical simulaton of field emission from silicon," *J. Vac. Sci. Technol. B,* vol. 11, No. 2, Mar./Apr. 1993, pp. 371–378.
"Optical Recording in Diamond–Like Carbon Films," *JJAP Series 6, Int. Symp. on Optical Memory,* 1991, pp. 116–120.
"Optimization of Amorphic Diamond™ for Diode Field Emission Displays," Microelectronics and Computer Technology Corporation and SI Diamond Technology, Inc.
"Planer [sic] Field Emission Devices with Three–Dimensional Gate Structures," *Technical Digest of IVMC 91,* Nagahama 1991, pp. 78–79.
"Real–time, in situ photoelectron emission microscopy observation of CVD diamond oxidation and dissolution on molybdenum," *Diamond and Related Materials,* vol. 3, 1994, pp. 1066–1071.
"Recent Development on 'Microtips' Display at LETI," *Technical Digest of IVMC 91,* Nagahama, 1991, pp. 6–9.
"Schottky barrier height and negative electron affinity of titanium on (111) diamond," *J. Vac. Sci. Technol. B,* vol. 10, No. 4, Jul./Aug. 1992, pp. 1940–1943.
"Silicon Field Emitter Arrays for Cathodoluminescent Flat Panel Displays," CH–3071–8/91/0000–0141, 1991 IEEE.
"Simulation of Field Emission from Silicon: Self–Consistent Corrections Using the Wigner Distribution Function," *COMPEL,* vol. 12, No. 4, 1993, pp. 507–515.
"Single micromachined emitter characteristics," *J. Vac. Sci. Technol. B,* vol. 11, No. 2, Mar./Apr. 1993, pp. 396–399.
"Stability of the emission of a microtip," *J. Vac. Sci. Technol. B,* vol. 12, No. 2, Mar/Apr. 1994, pp. 685–688.
"Structure and Electrical Characteristics of Silicon Field–Emission Microelectronic Devices," *IEEE Transactions on Electron Devices,* vol. 38, No. 10, Oct. 1991, pp. 2309–2313.
"Substrate and Target Voltage Effects on Sputtered Hydrogenated Amorphous Silicon," *Solar Energy Materials,* vol. 11, 1985, pp. 447–454.
"Synchrotron radiation photoelectron emission microscopy of chemical–vapor–deposited diamond electron emitters," *J. Vac. Sci. Technol. A,* vol. 13, No. 3, May/Jun. 1995, pp. 1–5.
"Temperature dependence of I–V characteristics of vacuum triodes from 24 to 300 K," *J. Vac. Sci. Technol. B,* vol. 11, No. 2, Mar./Apr. 1993, pp. 400–402.
"The Field Emission Display: A New Flat Panel Technology," CH–3071–8/91/0000–0012 501.00 © 1991 IEEE.
"The nature of field emission sites," *J. Phys. D: Appl. Phys.,* vol. 8, 1975, pp. 2065–2073.
"Theoretical study of field emission from diamond," *Appl. Phys. Lett.,* vol. 65, No. 20, 14 Nov. 1994, pp. 2562–2564.
"Theory of electron emission in high fields from atomically sharp emitters: Validity of the Fowler–Nordheim equation," *J. Vac. Sci. Technol. B,* vol. 11, No. 2, Mar./Apr. 1993, pp. 387–391.
"The Semiconductor Field–Emission Photocathode," *IEEE Transactions on Electron Devices,* vol. ED–21, No. 12, Dec. 1974, pp. 785–797.
"The SIDT/MCC Amorphic Diamond Cathode Field Emission Display Technology," *David Sarnoff Research Center—Client Study,* Mar. 1994.
"The source of high–β electron emission sites on broad–area high–voltage alloy electrodes," *J. Phys. D: Appl. Phys.,* vol. 12, 1979, pp. 969–977.
"Thin–Film Diamond," *The Texas Journal of Science,* vol. 41, No. 4, 1989, pp. 343–358.
"Thin Film Emitter Development," *Technical Digest of IVMC 91,* Nagahama, 1991, pp. 118–119.
"Triode characteristics and vacuum considerations of evaporated silicon microdevices," *J. Vac. Sci. Technol. B.,* vol. 11, No. 2, Mar./Apr. 1993, pp. 422–425.
"Tunnelling theory and vacuum microelectronics," *Inst. Phys. Conf. Ser. No. 99: Section 5,* Presented at *2nd Int. Conf. on Vac. Microelectron.,* Bath, 1989, pp. 121–131.
"Ultrahigh–vacuum field emitter array wafer tester," *Rev. Sci. Instrum.,* vol. 58, No. 2, Feb. 1987, pp. 301–304.
"Use of Diamond Thin Films for Low Cost field Emissions Displays," *7th International Vacuum Microelectronics Conference Technical Digest,* 1994, pp. 229–232.
"Vacuum microtriode characteristics," *J. Vac. Sci. Technol. A,* vol. 8, No. 4, Jul./Aug. 1990, pp. 3581–3585.
"Wedge–Shaped Field Emitter Arrays for Flat Display," *IEEE Transactions on Electron Devices,* vol. 38, No. 10, Oct. 1991, pp. 2395–2397.
*Cathodoluminescence: Theory and Application,* Chapters 9 and 10, VCH Publishers, New York, NY, 1990.
"Cathodoluminescent Materials," *Electron Tube Design, D. Sarnoff Res. Center Yearly Reports & Review,* 1976, pp. 128–137.
"Electron Microscopy of Nucleation and Growth of Indium and Tin Films," *Philosophical Magazine,* vol. 26, No. 3, 1972, pp. 649–663.
"Improved Performance of Low Voltage Phosphors for Field Emission Displays," *SID Display Manufacturing Conf.,* Santa Clara, CA, Feb. 2, 1995.
"Phosphor Materials for Cathode–Ray Tubes," *Advances in Electronics and Electron Physics,* vol. 17, 1990, pp. 271–351.
"Phosphors and Screens," *Advances in Electronics and Electron Physics,* vol. 67, Academic Press, Inc., 1986, pp. 254, 272–273.
"The Chemistry of Artificial Lighting Devices—Lamps, Phosphors and Cathode Ray Tubes," *Studies in Inorganic Chemistry 17,* Elsevier Science Publishers B.V., The Netherlands, 1993, pp. 573–593.
Data Sheet on Anode Drive SN755769, Texas Instruments, pp. 4–81 to 4–88.
Data Sheet on Display Driver, HV38, Supertex, Inc., pp. 11–43 to 11–50.
Data Sheet on Voltage Driver, HV620, Supertex Inc., pp. 1–6, May 21, 1993.
Data Sheet on Voltage Drive, HV 622, Supertex Inc., pp. 1–5, Sep. 22, 1992.
"Light scattering from aggregated silver and gold films," *J. Opt. Soc. Am.,* vol. 64, No. 9, Sep. 1974, pp. 1190–1193.

DIODE STRUCTURE FLAT PANEL DISPLAY

RELATED APPLICATION

This is a division of application Ser. No. 07/995,846 filed Dec. 23, 1992 now U.S. Pat. No. 5,449,970.

The '846 application is a continuation-in-part of Ser. No. 07/851,701 which was filed on Mar. 16, 1992 abandoned, entitled "Flat Panel Display Based on Diamond Thin Films" and is incorporated herein by reference.

TECHNICAL FIELD OF THE INVENTION

This invention relates in general to flat panel displays for computers and the like and, more specifically, to such displays that are of a field emission type using a diode pixel structure in which the pixels are individually addressable.

BACKGROUND OF THE INVENTION

Conventional cathode ray tubes (CRTs) are used in display monitors for computers, television sets, and other video devices to visually display information. Use of a luminescent phosphor coating on a transparent face, such as glass, allows the CRT to communicate qualities such as color, brightness, contrast and resolution which, together, form a picture for the benefit of a viewer.

Conventional CRTs have, among other things, the disadvantage of requiring significant physical depth, i.e. space behind the actual display screen, resulting in such units being large and cumbersome. There are a number of important applications in which this physical depth is deleterious. For example, the depth available for many compact portable computer displays precludes the use of conventional CRTs. Furthermore, portable computers cannot tolerate the additional weight and power consumption of conventional CRTs. To overcome these disadvantages, displays have been developed which do not have the depth, weight or power consumption of conventional CRTs. These "flat panel" displays have thus far been designed to use technologies such as passive or active matrix liquid crystal displays ("LCD") or electroluminescent ("EL") or gas plasma displays.

A flat panel display fills the void left by conventional CRTs. However, the flat panel displays based on liquid crystal technology either produce a picture which is degraded in its fidelity or is non-emissive. Some liquid crystal displays have overcome the non-emissiveness problem by providing a backlight, but this has its own disadvantage of requiring more energy. Since portable computers typically operate on limited battery power, this becomes an extreme disadvantage. The performance of passive matrix LCD may be improved by using active matrix LCD technology, but the manufacturing yield of such displays is very low due to required complex processing controls and tight tolerances. EL and gas plasma displays are brighter and more readable than liquid crystal displays, but are more expensive and require a significant amount of energy to operate.

Field emission displays combine the visual display advantages of the conventional CRT with the depth, weight and power consumption advantages of more conventional flat panel liquid crystal, EL and gas plasma displays. Such field emission displays use very sharp micro-tips made of tungsten, molybdenum or silicon as the cold electron emitter. Electrons emitted from the cathode due to the presence of an electric field applied between the cathode and the grid bombard the phosphor anode, thereby generating light.

Such a matrix-addressed flat panel display is taught in U.S. Pat. No. 5,015,912, which issued on May 14, 1991, to Spindt et al., and which uses micro-tip cathodes of the field emission type. The cathodes are incorporated into the display backing structure, and energize corresponding cathodoluminescent areas on a face plate. The face plate is spaced 40 microns from the cathode arrangement in the preferred embodiment, and a vacuum is provided in the space between the plate and cathodes. Spacers in the form of legs interspersed among the pixels maintain the spacing, and electrical connections for the bases of the cathodes are diffused sections through the backing structure.

An attribute of the invention disclosed in Spindt et al. is that it provides its matrix-addressing scheme entirely within the cathode assembly. Each cathode includes a multitude of spaced-apart electron emitting tips which project upwardly therefrom toward the face structure. An electrically conductive gate or extraction electrode arrangement is positioned adjacent the tips to generate and control electron emission from the latter. Such arrangement is perpendicular to the base stripes and includes apertures through which electrons emitted by the tips may pass. The extraction electrode is addressed in conjunction with selected individual cathodes to produce emission from the selected individual cathodes. The grid-cathode arrangement is necessary in micro-tip cathodes constructed of tungsten, molybdenum or silicon, because the extraction field necessary to cause emission of electrons exceeds 50 Megavolts per meter ("MV/m"). Thus, the grid must be placed close (within approximately 1 micrometer) to the micro-tip cathodes. These tight tolerances require that the gate electrodes be produced by optical lithographic techniques on an electrical insulating layer which electrically separates the gates of each pixel from the common base. Such photolithography is expensive and difficult to accomplish with the accuracy required to produce such a display, thereby raising rejection rates for completed displays.

The two major problems with the device disclosed in Spindt et al. are 1) formation of the micro-tip cathodes and 2) formation and alignment of the extraction electrodes with respect to the cathodes. The structure disclosed in Spindt et al. is extremely intricate and difficult to fabricate in the case of large area displays. Thus, the invention disclosed in Spindt et al. does not address the need for a flat panel display which is less complicated and less expensive to manufacture.

The above-mentioned problems may be alleviated if the grid structure and sharp micro-tips are not needed. This may be accomplished by use of a flat cathode as the electron field emitter in a diode configuration where the anode is coated with a phosphor. No extraction grid is needed in such a display, thereby rendering the display relatively easy to construct.

Unfortunately, such field emission flat panel displays having a diode (cathode/anode) configuration suffer from several disadvantages.

First, the energy of electrons bombarding phosphors coating the anode is determined by the voltage between the cathode and the phosphors on the anode. In color displays, in which the phosphors must be excited by an especially high electron energy, cathode/anode voltage should be higher than 300 volts. This high voltage requirement causes cathode and anode drivers to be able to handle the higher voltage, thus making the drivers more expensive to manufacture. Such high voltage drivers are also relatively slow due to the time it takes to develop the higher voltage on conductors within the display.

According to Fowler-Nordheim ("F-N") theory, the current density of field emissions changes by as much as 10 percent when cathode/anode separation changes by only 1 percent. Prior art flat panel displays have not been completely successful in overcoming the problem of field emission variations.

All flat panel displays must employ an addressing scheme of some sort to allow information a computer or other device sends to the display to be placed in proper order. Addressing is simply the means by which individual display or picture elements (frequently called "pixels") are accessed and configured to display the information.

A related issue which must be addressed in the context of flat panel displays is proper spacing between anode and cathode assemblies. As has been discussed, proper spacing is critical in controlling field emission variation from one pixel to another and in minimizing the voltage required to drive the display. In triode displays, glass balls, fibers, polyimides and other insulators have been used to maintain proper separation. In such displays, separation is not as critical because the electric field between the anode and electron extraction grid is not as great (on the order of 10%) of the electric field between the grid and the cathode (the electron extraction field). In diode displays, a spacer must have a breakdown electric field much larger than the electron extraction field for the cathode.

To be useful in today's computer and video markets, flat panel displays must be able to create pictures having greys (half-tones) thereby allowing the displays to create graphical images in addition to textual images. In the past, both analog and duty-cycle modulation techniques have been used to implement grey-scale operation of a flat panel display.

The first of these is analog control. By varying voltage in a continuous fashion, individual pixels thus excited can be driven to variable intensities, allowing grey-scale operation. The second of these is duty-cycle modulation. One of the most often employed versions of this type of control is that of pulse-width modulation, in which a given pixel is either completely "on" or completely "off" at a given time, but the pixel is so rapidly switched between the "on" and "off" states that the pixel appears to assume a state between "on" and "off." If the dwell times in the "on" or "off" states are made unequal, the pixel can be made to assume any one of a number of grey states between black and white. Both of these methods are useful in controlling diode displays.

A matrix-addressable flat panel display which is simple and relatively inexpensive to manufacture and which incorporates redundancy for continued operation of each pixel within the display is required to overcome the above-noted disadvantages. The display should embody a sophisticated cathode/anode spacing scheme which is nonetheless reliable and inexpensive to manufacture. Finally, the display should also embody a scheme for implementing a grey scale mode within a flat panel display of diode pixel structure to allow individual pixels to assume shades between black and white, thereby increasing the information-carrying capacity and versatility of the display.

SUMMARY OF THE INVENTION

The present invention relates to a flat panel display arrangement which employs the advantages of a cathodoluminescent phosphor of the type used in CRTs, while maintaining a physically thin display. The flat panel display is of a field emission type using diode (two terminal) pixel structure. The display is matrix-addressable by using anode and cathode assemblies arranged in strips in a perpendicular relationship whereby each anode strip and each cathode strip are individually addressable by anode and cathode drivers respectively. Effectively, a "pixel" results at each crossing of an anode strip and a cathode strip. Both the anode strips and the cathode strips are isolated from one another to maintain their individual addressability. The result is that each pixel within the display may be individually illuminated.

The cathode assembly may be either a flat cathode or a set of micro-tips which may be randomly patterned or photolithographically patterned. The flat cathodes consist of a conductive material deposited over a substrate and a resistive material deposited over the conductive material. A thin film of low effective work function is then deposited over the resistive layer. In the preferred embodiment of the invention, the thin film is amorphic diamond. The cathode strips may be further subdivided to allow operation at a particular pixel site even if there is a failure in one of the divisions. The resistive layer, which may be constructed of high-resistivity diamond or similar materials, provides adequate isolation between the various subdivisions. These multiple subdivisions of a pixel may be implemented on either the anode or the cathode.

The anode assembly consists of a transparent conductive material such as indium-tin oxide (ITO) deposited over a substrate with a low energy phosphor, such as zinc oxide (ZnO), deposited over the conductive layer.

The resultant anode assembly and cathode assembly are assembled together with a peripheral glass frit seal onto a printed circuit board. The proper spacing is maintained between the two assemblies by spacers consisting of either glass fibers or glass balls or a fixed spacer produced by typical deposition technology. In the preferred embodiment of the invention, spacing is provided by a plurality of spacers disposed within holes formed in the cathode substrate so as to form a long surface path to thereby discourage leakage of current from the cathode to the anode by virtue of electron-induced conductivity. A vacuum is created within the space between the anode and cathode assemblies by removing gases via an exhaust tube. Systems for maintaining vacuums within such structures are well known in the art. Impurities within the vacuum are eliminated by a getter.

Individual rows and columns of anode strips and cathode strips are externally accessible by flexible connectors provided by typical semiconductor packaging technology. These connectors may be attached to anode and cathode drivers so as to provide the addressability of each pixel within the display.

An individual pixel is illuminated when the potential between portions of a cathode and anode strip corresponding to that pixel is sufficient to emit electrons from the cathode which then emanate toward the low energy phosphor material. Since such an emission of electrons requires a considerable amount of voltage, which requires additional circuitry to switch such a high voltage, a constant potential is provided between the anode and cathode assemblies that does not provide enough voltage for electron emission. The remaining voltage required to provide the threshold potential for electron emission between the anode and cathode assemblies is provided by voltage drivers attached to each anode and cathode strip. These voltage drivers may be known as anode drivers and cathode drivers, respectively.

A pixel is addressed and illuminated when the required driver voltage is applied to a corresponding anode strip and cathode strip resulting in emission of electrons from that portion of the cathode strip adjacent to the anode strip.

Electrons are not emitted within a pixel area if only the corresponding anode strip, or corresponding cathode strip, are solely driven by the required driver voltage since the needed threshold potential between the anode and cathode is not achieved.

The present invention has the ability to implement the display in grey scale mode by either providing a variable voltage to individual pixels, by providing a modulated constant voltage (as in pulse-width modulation) or by subdividing each of the anode strips into strips of various widths which are individually addressable by the anode drivers. These individual strips may be addressed in various combinations resulting in activation of various amounts of light emitting phosphor material within a pixel by emitted electrons from the corresponding cathode.

Some of the advantages of the present invention include low power consumption, high brightness, low cost and low drive voltage. Additionally, the cathode assembly of the present invention is less complicated and less expensive to manufacture than micro-tip based triode displays since sophisticated photolithography is not required to produce a flat cathode arrangement.

Accordingly, it is a primary object of the present invention to provide a flat panel display comprising 1) a cathode assembly having a plurality of cathodes, each cathode including a layer of cathode conductive material and a layer of a low effective work-function material deposited over the cathode conductive material and 2) an anode assembly having a plurality of anodes, each anode including a layer of anode conductive material and a layer of cathodoluminescent material deposited over the anode conductive material, the anode assembly located proximate the cathode assembly to thereby receive charged particle emissions from the cathode assembly, the cathodoluminescent material emitting light in response to the charged particle emissions.

Another object of the present invention is to provide a display wherein a plurality of cathodes have a relatively flat emission surface comprising a low effective work-function material arranged to form a plurality of micro-crystallites.

A further object of the present invention is to provide a display wherein a plurality of cathodes have micro-tipped emission surfaces.

Still a further object of the present invention is to provide a display wherein a plurality of cathodes are randomly fabricated.

Yet another object of the present invention is to provide a display wherein a plurality of cathodes are photolithographically fabricated.

Another object of the present invention is to provide a display wherein micro-crystallites function as emission sites.

Still another object of the present invention is to provide a display wherein a low effective work-function material is amorphic diamond film.

And another object of the present invention is to provide a display wherein emission sites contain dopant atoms.

A further object of the present invention is to provide a display wherein a dopant atom is carbon.

Yet a further object of the present invention is to provide a display wherein emission sites have a different bonding structure from surrounding, non-emission sites.

Yet still another object of the present invention is to provide a display wherein emission sites have a different bonding order from surrounding, non-emission sites.

And still another object of the present invention is to provide a display wherein emission sites contain dopants of an element different from a low effective work-function material.

And another object of the present invention is to provide a display wherein emission sites contain defects in crystalline structure.

Yet another object of the present invention is to provide a display wherein defects are point defects.

Yet a further object of the present invention is to provide a display wherein defects are line defects.

Still a further object of the present invention is to provide a display wherein defects are dislocations.

Another primary object of the present invention is to provide a flat panel display comprising 1) a plurality of corresponding light-emitting anodes and field-emission cathodes, each of the anodes emitting light in response to electron emission from each of the corresponding cathodes and 2) means for selectively varying field emission between the plurality of corresponding light-emitting anodes and field-emission cathodes to thereby effect an addressable grey-scale operation of the flat panel display.

A further object of the present invention is to provide a display wherein emission between a plurality of corresponding light-emitting anodes and field-emission cathodes is varied by application of a variable electrical potential between selectable ones of the plurality of corresponding light-emitting anodes and field-emission cathodes.

Another object of the present invention is to provide a display wherein emission between a plurality of corresponding light-emitting anodes and field-emission cathodes is varied by applying a switched constant electrical potential between selectable ones of the plurality of corresponding light-emitting anodes and field-emission cathodes.

Yet another object of the present invention is to provide a display wherein a constant electrical potential is pulse width modulated to provide an addressable grey-scale operation of the flat panel display.

A further primary object of the present invention to provide a flat panel display comprising 1) a plurality of light-emitting anodes excited in response to electrons emitted from a corresponding one of a plurality of field-emission cathodes and 2) a circuit for electrically exciting a particular corresponding cathode and anode pair by changing an electrical potential of both the cathode and the anode of the pair.

A further object of the present invention is to provide a display wherein the plurality of cathodes is divided into cathode subdivisions.

Another object of the present invention is to provide a display wherein the plurality of anodes is divided into anode subdivisions.

Yet another object of the present invention is to provide a display wherein each of the cathode subdivisions are independently addressable.

Still another object of the present invention is to provide a display wherein each of the anode subdivisions are independently addressable.

Still yet another object of the present invention is to provide a display wherein the cathode subdivisions are addressable in various combinations to allow a grey scale operation of the cathodes.

And another object of the present invention is to provide a display wherein the anode subdivisions are addressable in various combinations to allow a grey scale operation of the anodes.

Another object of the present invention is to provide a display wherein the cathode subdivisions are of various sizes.

Yet another object of the present invention is to provide a display wherein the anode subdivisions are of various sizes.

Still another object of the present invention is to provide a display wherein the sizes of the cathode subdivisions are related to one another by powers of 2.

Still yet another object of the present invention is to provide a display wherein the sizes of the anode subdivisions are related to one another by powers of 2.

And another object of the present invention is to provide a display wherein the plurality of anodes comprise phosphor strips.

Another object of the present invention is to provide a display wherein each of the plurality of cathodes comprises:

a substrate;

an electrically resistive layer deposited over the substrate; and a layer of material having a low effective work-function deposited over the resistive layer.

Yet another object of the present invention is to provide a display wherein the plurality of anodes and the plurality of cathodes are continuously separated during operation by an electrical potential provided by a diode biasing circuit.

Still another object of the present invention is to provide a display wherein a particular corresponding cathode and anode pair is activated in response to application of a total electrical potential equal to a sum of the electrical potential provided by the diode biasing circuit and an electrical potential provided by a driver circuit.

Still yet another object of the present invention is to provide a display wherein the electrical potential provided by the driver circuit is substantially less than the electrical potential provided by the diode biasing circuit.

In the attainment of the foregoing objects, the preferred embodiment of the present invention is a system for implementing a grey scale in a flat panel display, the system comprising 1) a plurality of field emission cathodes arranged in rows, 2) a plurality of light emitting anodes arranged in columns, each column subdivided into sub-columns, the anodes responsive to electrons emitted from the cathodes, 3) a circuit for joining the rows of cathodes and the columns of anodes to form a pattern of pixels and 4) a circuit for independently and simultaneously addressing a cathode row and a combination of anode subcolumns within an anode column to thereby produce various levels of pixel intensity.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and the specific embodiment disclosed may be readily used as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE INVENTION

Figure 1:
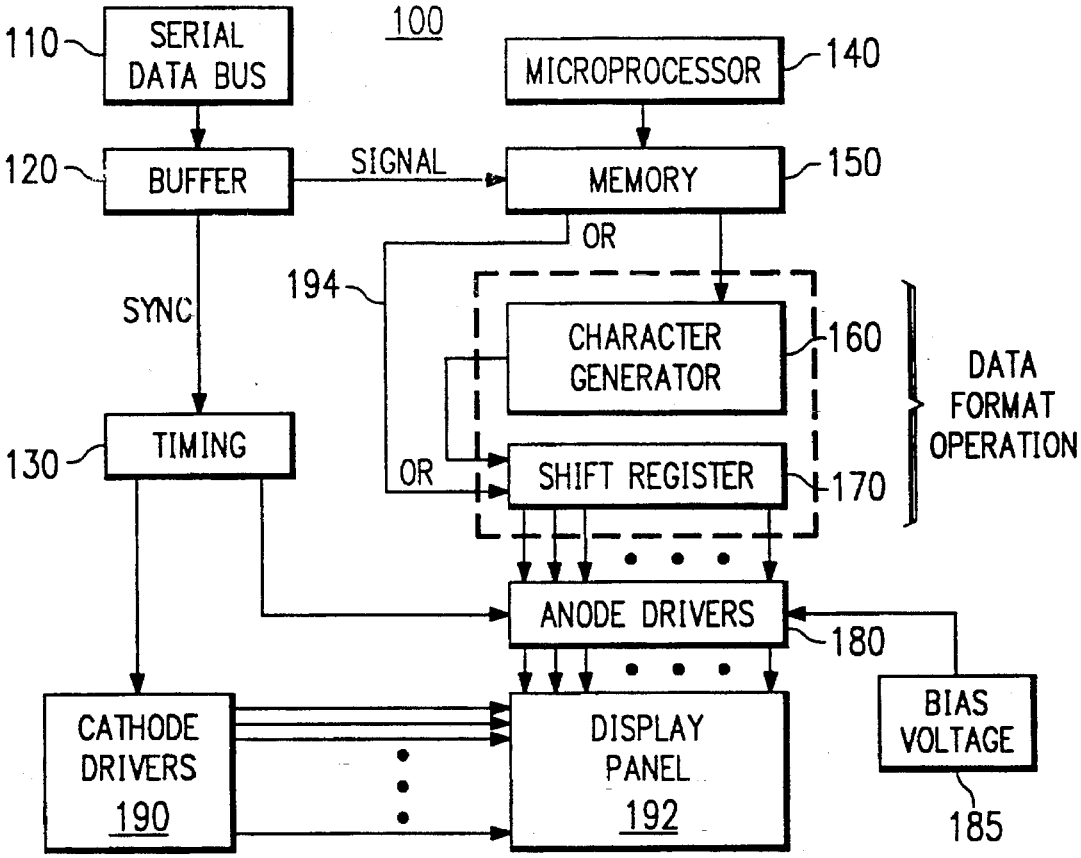
FIG. 1 is a schematic block diagram of a diode flat panel display system, including an addressing scheme employed by the preferred embodiment of the invention.

Referring to FIG. 1, there is shown a schematic of a typical system 100 for implementing the matrix-addressed flat panel display of the present invention. Typically, data representing video, video graphics or alphanumeric characters arrives into the system 100 via the serial data bus 110 where it is transferred through a buffer 120 to a memory 150. The buffer 120 also produces a synchronization signal which it passes on to the timing circuit 130.

A microprocessor 140 controls the data within the memory 150. If the data is video and not information defining alphanumeric characters, it is passed directly to the shift register 170 as bit map data as represented by flow line 194. The shift register 170 uses the received bit map data to actuate the anode drivers 180. As shown in FIG. 1, a voltage driver 185 supplies a bias voltage to the anode drivers 180 in a manner which will be explained in more detail in conjunction with a description of FIG. 3.

If the data arriving into the system 100 consists of alphanumeric characters, the microprocessor 140 transfers this data from the memory 150 into the character generator 160 which feeds the requisite information defining the desired character to a shift register 170 which controls operation of the anode driver 180. The shift register 170 also performs the task of refreshing the images presented to the display panel 192.

The anode drivers 180 and cathode drivers 190 receive timing signals from the timing circuit 130 in order to synchronize operation of the anode driver 180 and cathode drivers 190. Only the anode drivers 180 are concerned with the actual data and corresponding bit map images to be presented by the display panel 192. The cathode drivers are simply concerned with providing synchronization with the anode drivers 180 to provide the desired image on the display panel 192.

In an alternative embodiment of the system 100 shown in FIG. 1, the serial data bus 110 simply determines the mode of presentation on the display panel 192, such as screen resolution, color, or other attributes. For example, the buffer 120 would use this data to provide the proper synchronization signal to the timing circuit 130 which would then provide timing signals to the anode drivers 180 and the cathode drivers 190 in order to provide the correct synchronization for the image to be displayed. The microprocessor 140 would provide the data to be presented to the memory 150 which would then pass on any video or video graphics data to the shift register 170, or transfer alphanumeric data to the character generator 160. The shift register 170, anode drivers 180 and cathode drivers 190 would operate as previously described to present the proper images onto the display panel 192.

Figure 2:
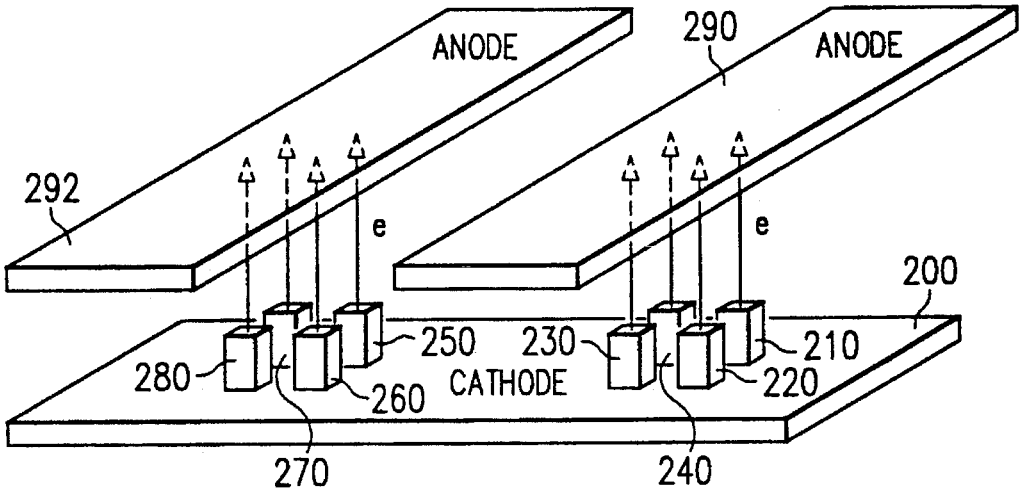
FIG. 2 shows a cathode having multiple field emitters for each pixel.

Referring next to FIG. 2, there is shown a typical operation of an embodiment of the present invention at two pixel sites. A cathode strip 200 contains multiple field emitters 210, 220, 230, 240 and emitters 250, 260, 270, 280 for each pixel, respectively. This design reduces the failure rate for each pixel, which increases the lifetime of the display and manufacturing yield. Since each emitter 210, 220, 230, 240 and emitters 250, 260, 270, 280 for each pixel has an independent resistive layer, the rest of the emitters for the same pixel will continue to emit electrons if one of the emitters on the pixel fails. For example, if field emitter 230 fails, anode strip 290 will continue to be excited by electrons at the site occupied by the crossing of anode strip 290 and cathode strip 200 since field emitters 210, 220 and 240 remain. This redundancy will occur at each pixel location except for the highly unlikely occurrence of all field emitters failing at a pixel location. For example, field emitters 250, 260, 270 and 280 would all have to fail in order for the pixel location at the crossing of anode strip 292 and cathode strip 200 to become inoperable.

As previously mentioned, one way to reduce field emission variation is to employ current-limiting cathode/anode drivers. Such drivers are commercially available (voltage driver chips such as Texas Instruments serial numbers 755, 777 and 751,516). In current-limiting drivers, as long as the operating voltage of the driver exceeds the voltage required to cause the cathode/anode pair having the highest threshold emission voltage to activate, all cathode/anode pairs will emit with the same operating current/voltage Q point.

Figure 3:
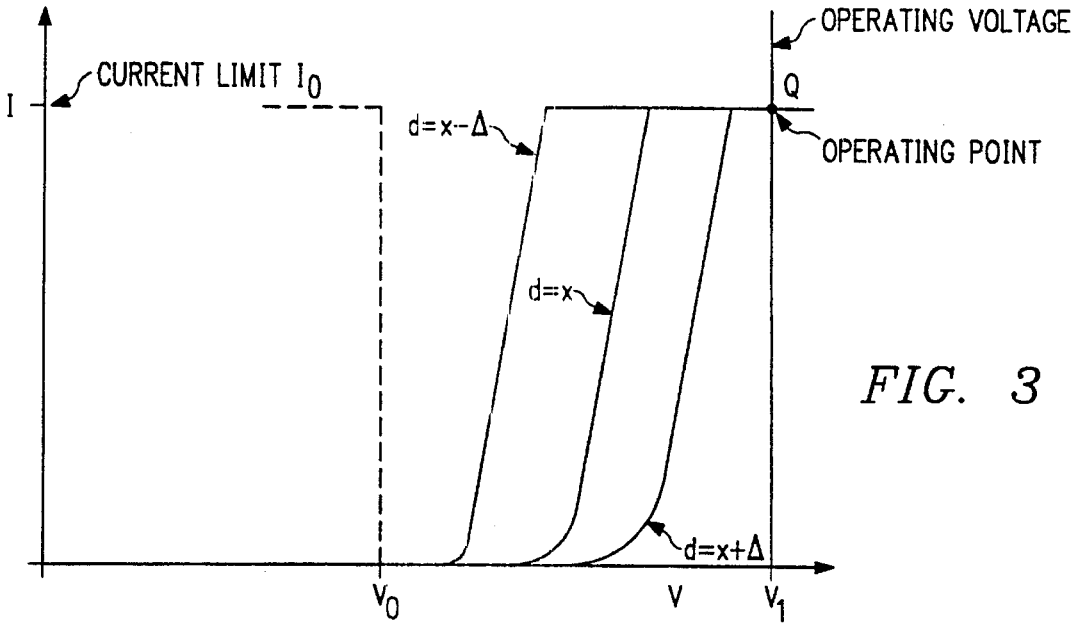
FIG. 3 shows a current-voltage curve for operation of a diode flat panel display.

For an example of the principle of this method, FIG. 3 shows a current-voltage curve for a diode display. The voltage $V_0$ may be a voltage in which the drivers are biased. By changing from $V_0$ to $V_1$, display brightness or intensity can be changed. Similarly, $I_0$ can be changed to adjust display brightness or intensity. The manner of coupling the current-limiting drivers to the display will be described in connection with FIG. 5.

Figure 4:
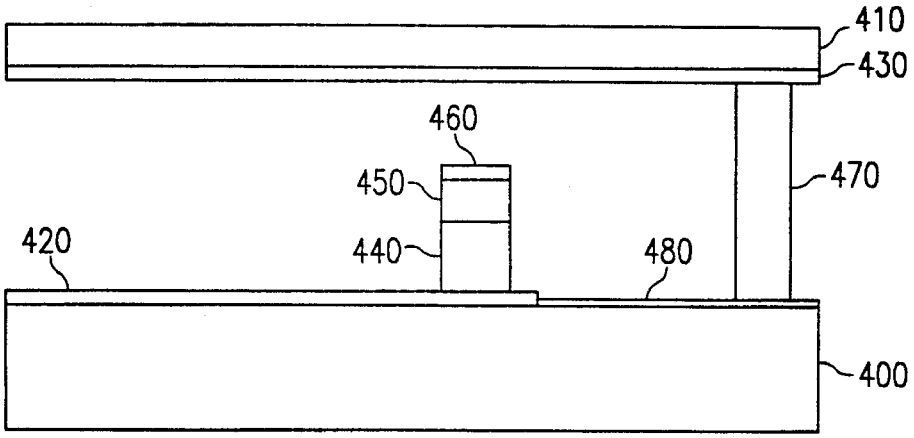
FIG. 4 shows a first method for providing proper spacing in a diode flat panel display.

Turning now to FIG. 4, and as mentioned earlier, according to F-N theory, the current density of field emissions changes by as much as 10 percent when cathode/anode separation changes by only 1 percent. One method employable to reduce this variation is to interpose a resistive element between each cathode and its corresponding cathode conductor as described in Ser. No. 07/851,701. Unfortunately, interposing the resistive element can result in a voltage drop across the resistive element, with a corresponding power dissipation, thereby increasing overall power consumption of the display. Sometimes the added power consumption is acceptable.

FIG. 4 illustrates an arrangement employing a resistive element in a cathode to reduce field variations. Also shown is a first method for providing proper spacing in a diode flat panel display. Shown in FIG. 4 is a cathode substrate 400. Upon the cathode substrate 400 rests a cathode conductive layer 420, a conductive pillar 440, a resistive element 450 and an emission material 460 having a low effective work-function.

A low effective work-function material is any material which has a threshold electric field less than 50 Megavolts per meter ("MV/m"). Examples of low effective work-function material include amorphic diamond (defined as a non-crystalline carbon prepared without hydrogen and having diamond-like properties as described in Collins et al., The Texas Journal of Science, vol. 41, no. 4, 1989, "Thin Film Diamond" pp. 343–58), cermets (defined as any of a group of composite materials made by mixing, pressing and sintering metal with ceramic or by thin film deposition technology, such as graphite-diamond, silicon-silicon carbide and tri-chromium monosilicide-silicon dioxide) or coated micro-tips (which have been either randomly or photo-lithographically fabricated).

In addition, in FIG. 4, there is provided an anode substrate 410 upon which is deposited a cathodoluminescent layer 430. A pillar 470 maintains a proper spacing between the emission material 460 and the cathodoluminescent layer 430. In the preferred embodiment of the invention, the cathode substrate 400 is glass, the cathode conductive layer 420 is a metal tracing, such as copper, the conductive pillar 440 is copper, the emission material 460 is amorphic diamond thin film, the anode substrate is 410 is glass, the cathodoluminescent layer 430 is ITO and the pillar 470 is a dielectric material.

In a diode display, a pillar must have a breakdown voltage much larger than the electron extraction field for the cathode. In the case of a cathode constructed of amorphic diamond film, the electron extraction field is on the order of 15–20 MV/m. But, in a diode field emission display, it has been found that pillars have a breakdown voltage on the order of 5 MV per meter. This is attributed to electron-induced conductivity occurring on the surface of the pillar. Accordingly, as shown conceptually in FIG. 4, a goal of successful spacing is to increase the surface distance from the cathode to the anode so as to minimize the effects of electron-induced conductivity. Specifically, for current to travel from the cathode to the anode via the pillar, the current must traverse a circuitous path along surface 480 in FIG. 4. In the structure shown in FIG. 4, the cathode and anode conductors are separated by 100 micorns, while the emission surface of the cathode and the anode conductor are separated by 20 microns.

Figure 5:
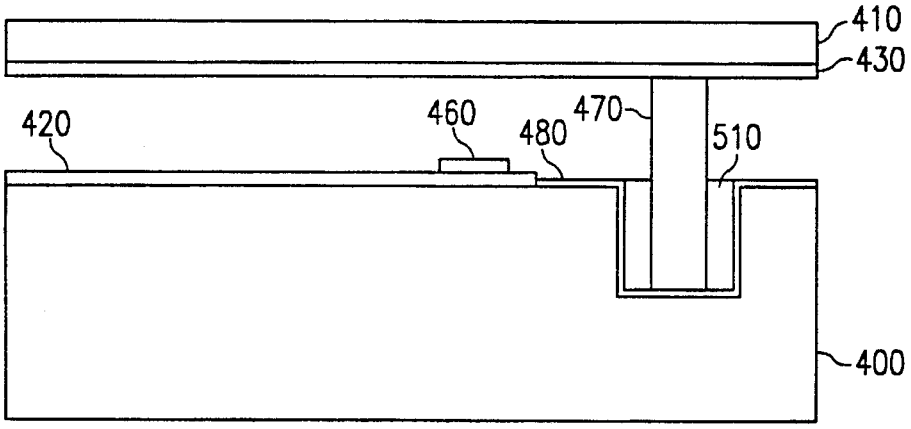
FIG. 5 shows a second method for providing proper spacing in a diode flat panel display employed in the/ preferred embodiment of the present invention.

Turning now to FIG. 5, shown is a second method for providing proper spacing in a diode flat panel display which is employed in the preferred embodiment of the present invention. The second method is preferable to that detailed in FIG. 4 because it calls for only 1000–2000 spacers in a typical flat panel display, as opposed to 200,000–1,000,000 pillars as required in the first method. In the method shown in FIG. 5, a spacer 470 is located within a recess 510 in the cathode substrate 400. The spacer 470 can be constructed of tungsten, molybdenum, aluminum, copper, or other metals. The spacer 470 can be conductive because the surface 480 separating the emission material 460 from the cathodoluminescent layer 430 is great, thereby discouraging electron-induced conduction. The spacer 470 may also be constructed of an insulating material, such as silicon dioxide. To provide this increased surface distance, the cathode substrate 400 is provided with a plurality of small recesses 510 (on the order of 25–50 microns in diameter and 75–250 microns deep which are used to receive the spacers). The recesses can be made at a spacing of 0.5 cm and preferably reside between individual cathode and anode stripes. In the structure shown in FIG. 5, the cathode and anode conductors 420, 430 are separated by 20 microns, and the emission material 460 and the anode conductive layer 430 are separated by roughly the same distance. Spacers are preferably 30 microns in diameter.

Figure 6:
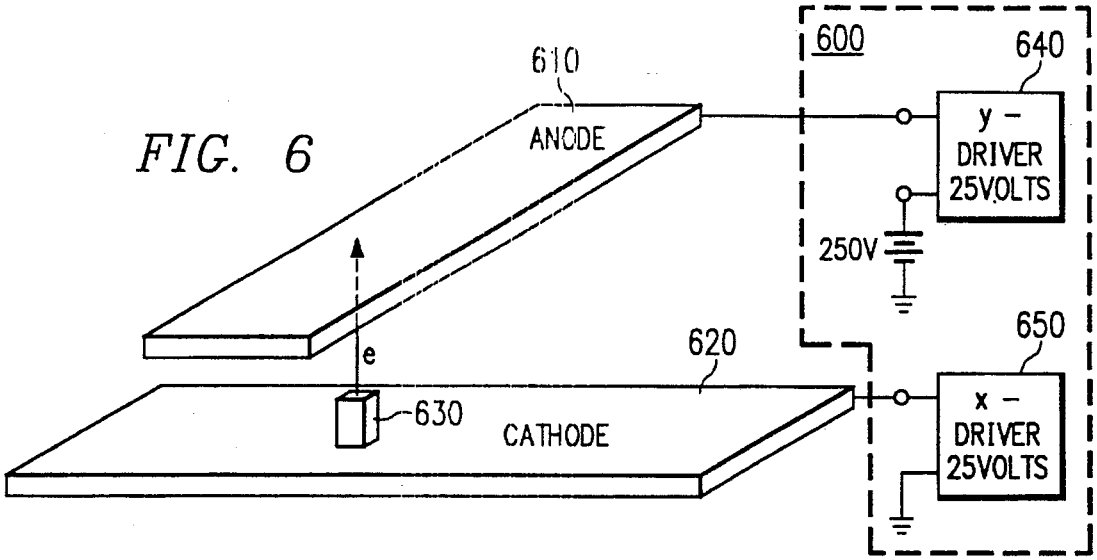
FIG. 6 shows a diode biasing circuit with voltage/drivers for the anode and cathode.

Referring now to FIG. 6, a diode biasing circuit 600 is used to drive the display 192 with the operating voltage at a threshold potential required by the low effective work-function material deposited on the cathode. This threshold voltage is applied between an anode strip 610 and a cathode strip 620 resulting in electrons being emitted from a field emitter 630 to the anode 610. For full color display, the anode 610 is patterned in three sets of stripes, each covered with a cathodoluminescent material. Pixels are addressed by addressing a cathode 620 which is perpendicular to a corresponding anode strip 610. The cathode strip 620 is addressed by a 25 volt driver 650 and the anode strip 610 is driven by another 25 volt driver 640 which is floating on a 250 volt DC power supply. The output voltage of 250 volts from the DC power supply is chosen to be just below the threshold voltage of the display. By sequential addressing of these electrodes an image (color or monochrome) can be displayed. These voltages given are only representative and may be replaced by other various combinations of voltages. Additionally, other thin film cathodes may require different threshold potentials for field emission.

Figure 7:
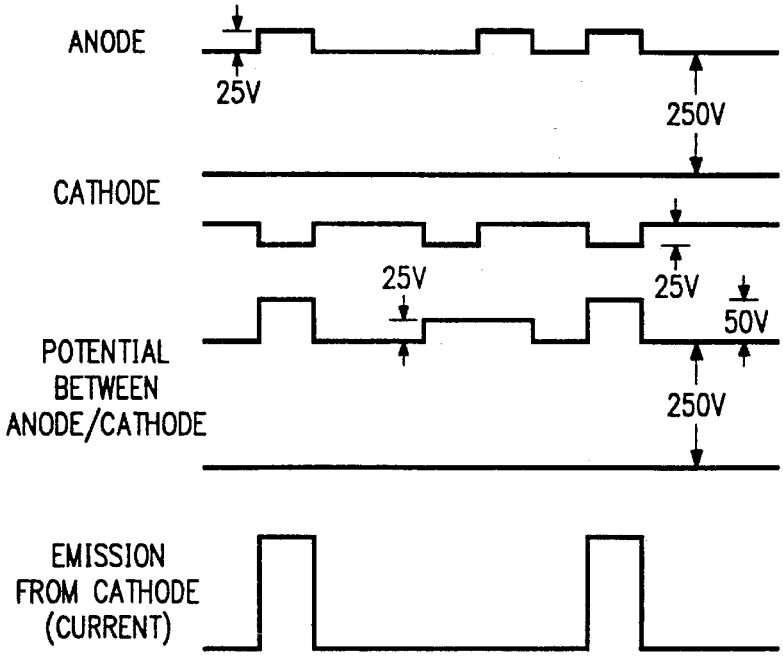
FIG. 7 is a diagram of the potential required between an anode and a cathode to result in emission at an addressed pixel.

FIG. 7 illustrates how emission from a cathode is obtained at a pixel location by addressing the cathode strips and anode strips within the display using the voltage drivers 640, 650.

Figure 8:
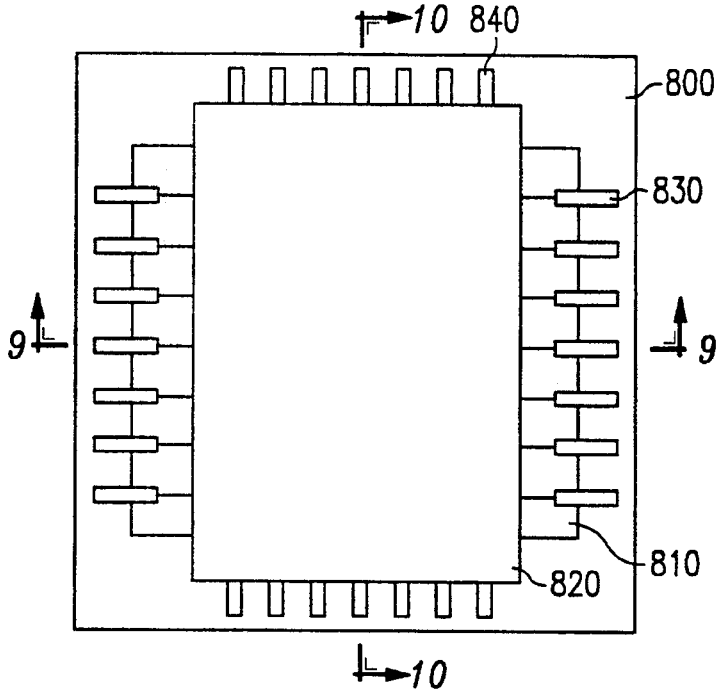
FIG. 8 is an illustration of the anode and cathode assemblies on a printed circuit board.

Referring now to FIG. 8, a top view of the flat panel display 192 illustrates the basic anode-cathode structure used to accomplish the matrix addressing scheme for presenting images onto the display 192. An anode assembly 820 is joined with a cathode assembly 810 in a perpendicular relationship, as illustrated in FIGS. 2 and 6, upon a printed circuit board (PCB) 800 or other suitable substrate. Typical semiconductor mounting technology is used to provide external contacts 830 for the cathode assembly and external contacts 840 for the anode assembly.

As mentioned earlier, one of the best ways to reduce field variation is to employ a combination of resistive elements and current-limiting drivers. In this case, the drivers are used to control the total current delivered to the display, while individual resistive elements are used to minimize variation in field intensity between the various cathode/anode pairs (or within portions of cathode/anode pairs). The resistive elements further help to limit current in case a particular cathode/anode pair shorts together (such that there is no gap between the cathode and the anode). In FIG. 8, current-limiting drivers (not shown), each have a plurality of voltage outputs coupled in a conventional manner to the contacts 830, 840 to thereby provide the contacts 830, 840 with appropriate voltages to control the display. These current-limiting voltage drivers limit current delivery to the contacts 830, 840 in a manner described in FIG. 3.

Figure 9:
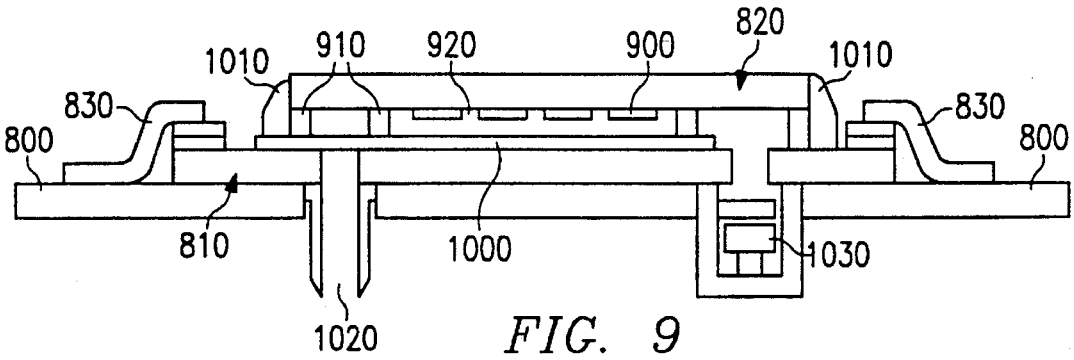
FIG. 9 is cross-section of FIG. 8 illustrating the anode strips.

Turning now to FIG. 9, which shows cross-section 9—9 of the display panel 192 of FIG. 8, the PCB 800 is used to mount the cathode assembly 810 and anode assembly 820 using technology well known in the art. The cathode assembly 620 in FIG. 6 illustrates one row of a cathode strip 1000 which is shown in more detail in FIG. 11. The cathode strip 1000 is accessed electrically from the outside by connectors 830. The anode assembly 820 and the cathode assembly 810 are assembled together with a peripheral glass frit seal 1010. Spacers 910 maintain the anode-cathode spacing required for proper emission of electrons. The spacers 910 may be glass fibers or glass balls or may be a fixed spacer implanted by well known deposition technology.

An exhaust tube 1020 is used with a vacuum pump (not shown) to maintain a vacuum in the space 920 between the anode assembly 820 and the cathode assembly 810. After a vacuum inside the panel reaches $10^{-6}$ Tort or lower, the exhaust tube 1020 is closed and the vacuum pump (not shown) is removed. A getter 1030 is used to attract undesirable elements outgassing from the various materials used to construct the display, namely glass and spacer and cathode materials within the space 920. Typically a getter is composed of a material that has a strong chemical affinity for other materials. For example, barium could be introduced in filament form as a filament getter, into the space 920, which is now a sealed vacuum in order to remove residual gases.

Figure 10:
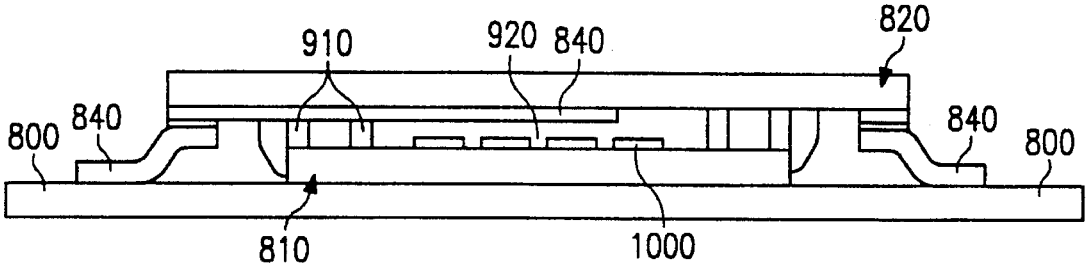
FIG. 10 is cross-section of FIG. 8 illustrating the cathode strips.

Referring next to FIG. 10, there is shown cross-section 10—10 of FIG. 8 which shows in greater detail the rows of cathode strips 1000 in their perpendicular relationship to the anode strips 900. The cathode strips 1000 are spaced sufficiently apart to allow for isolation between the strips 1000. The external connectors 840 to the anode assembly 820 are also shown.

By observing the perpendicular relationship of the anode strips 900 and the cathode strips 1000 in FIGS. 2–10, it can be understood how the present invention allows for matrix addressing of a particular "pixel" within the display panel 192. Pixels are addressed by the system of the present invention as shown in FIG. 1. Anode drivers 180 provide a driver voltage to a specified anode strip 900, and cathode drivers 190 provide a driver voltage to a specified cathode strip 1000. The anode drivers 180 are connected to the anode strip 900 by external connectors 840. The cathode drivers 190 are electrically connected to the cathode strips 1000 by external connectors 830. A particular "pixel" is accessed when its corresponding cathode strip 1000 and anode strip 900 are both driven by their respective voltage drivers. In that instance the driver voltage applied to the anode driver 180 and the driver voltage applied to the cathode driver 190 combine with the DC voltage to produce a threshold potential resulting in electrons being emitted from the cathode strip 1000 to the anode strip 900 which results in light being emitted from the low energy phosphor applied to the anode strip 900 at the particular location where the perpendicularly arranged cathode strip 1000 and anode strip 900 cross paths.

Figure 11:
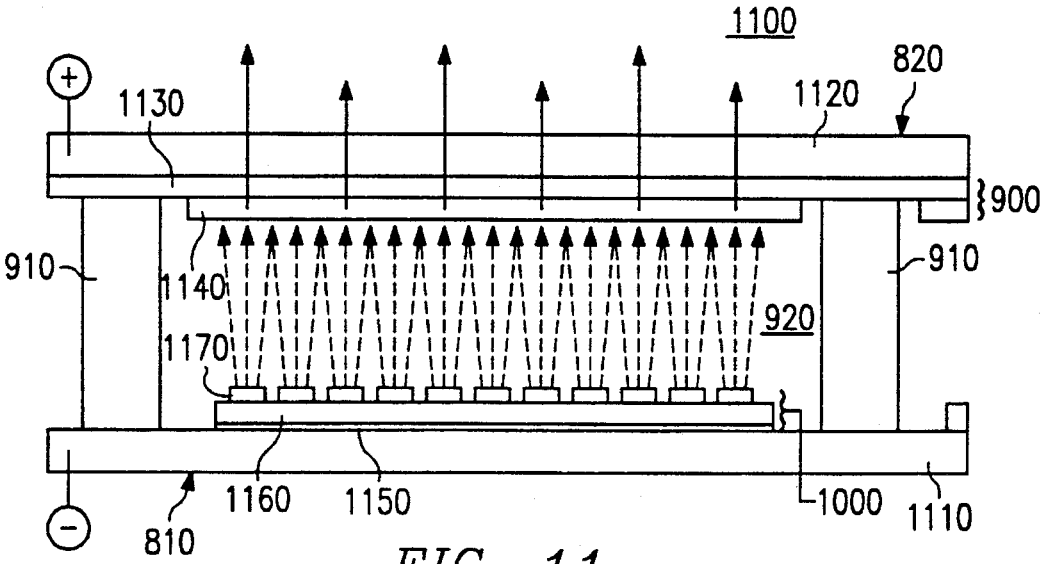
FIG. 11 is a detail of the operation of a pixel within the flat panel display.

Referring now to FIG. 11, there is shown a detailed illustration of a "pixel" 1100. The cathode assembly 810 consists of a substrate 1110, typically glass, a conductive layer 1150, a resistive layer 1160 and the flat cathodes 1170. The conductive layer 1150, resistive layer 1160 and flat cathodes 1170 comprise a cathode strip 1000. The individual flat cathodes 1170 are spaced apart from each other resulting in their isolation maintained by the resistive layer 1160. The anode assembly 820 consists of a substrate 1120, typically glass, a conductive layer 1130, typically ITO and a low energy phosphor 1140, such as ZnO.

The pixel 1100 is illuminated when a sufficient driver voltage is applied to the conductive layer 1150 of the cathode strip 1000 associated with the pixel 1100, and a sufficient driver voltage is also applied to the ITO conductive layer 1130 of the anode strip 900 corresponding to that particular pixel 1100. The two driver voltages combine with the constant DC supply voltage to provide a sufficient total threshold potential between the sections of the anode strip 900 and cathode strip 1000 associated with the pixel 1100. The total threshold potential results in electron emission from the flat cathodes 1170 to the low energy phosphor 1140 which emits light as a result.

As may be noted by referring to FIGS. 2 and 11, each cathode strip 1000 employs a multitude of isolated flat cathodes 1170 which illuminates the pixel 1100 even if one or more (but not all) of the flat cathodes 1170 fail since the remaining flat cathodes 1170 will continue to operate.

Figure 12:
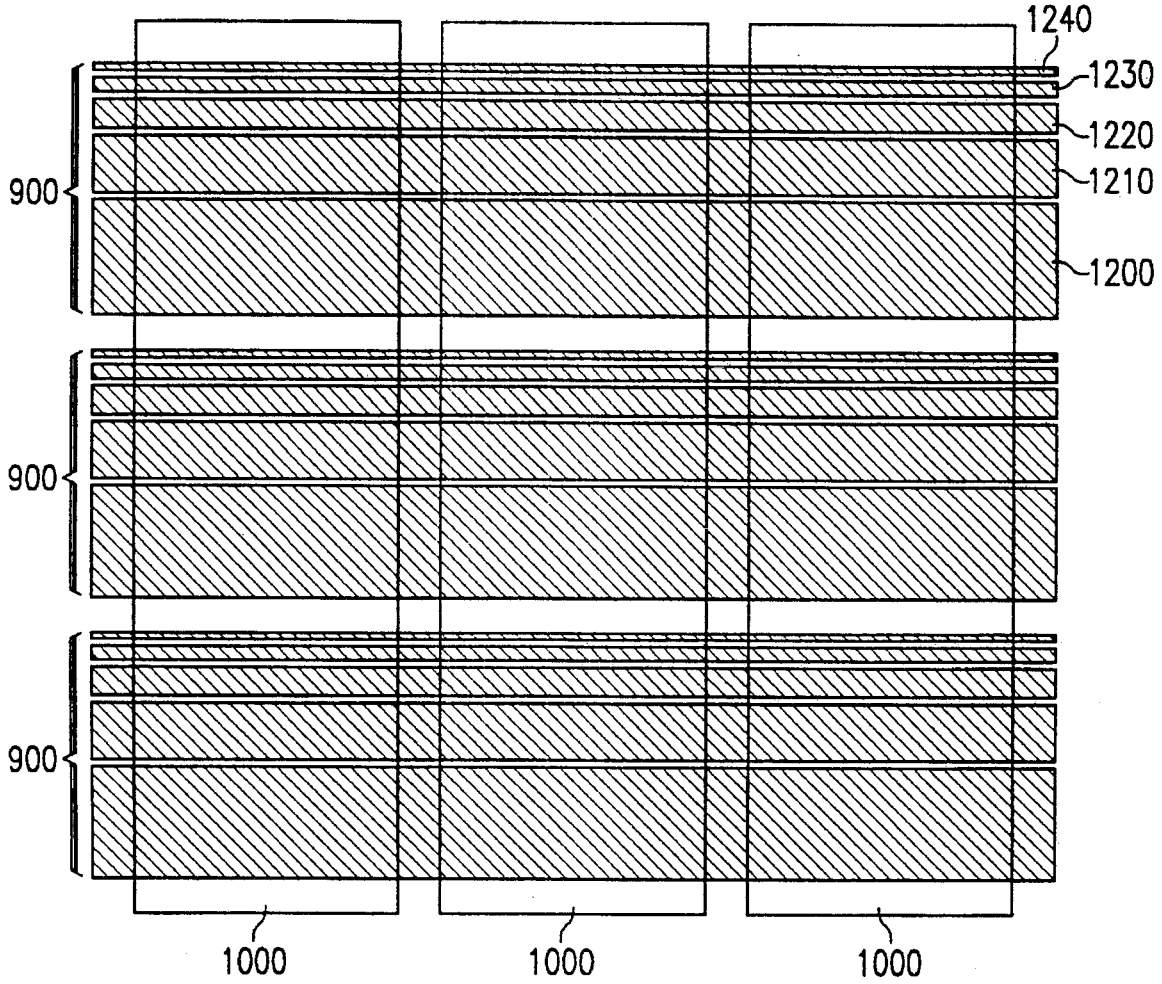
FIG. 12 illustrates subdivision of the anode strips for implementation of a grey scale mode within the display.

Referring now to FIG. 12, there is shown an implementation of a grey scale mode on the flat panel display 192. The cathode strips 1000 are arranged perpendicularly with the anode strips 900. However, each anode strip 900 may be further subdivided into various smaller strips 1200, 1210, 1220, 1230, 1240 of equal or different widths. Each subdivision is isolated from the adjacent subdivision by a sufficient gap to maintain this isolation. The individual subdivided strips 1200, 1210, 1220, 1230, 1240 are independently addressable by the anode drivers 180. The result is that a pixel 1100 may be illuminated in a grey scale mode. For example, if subdivisions 1200 and 1230 are applied a driver voltage by their corresponding anode drivers 180, and subdivisions 1210, 1220 and 1240 are not given a driver voltage, then only the low energy phosphor associated with subdivisions 1200 and 1230 will be activated by the corresponding cathode strip 1000 resulting in less than maximum illumination of the pixel 1100.

As can be seen, the subdivisions 1200, 1210, 1220, 1230, 1240 may be activated in various combinations to provide various intensities of illumination of the pixel 1100. The individual subdivided strips are of various sizes which are related to one another by powers of 2. If, for instance, there are 5 strips having relative sizes of 1, 2, 4, 8 and 16, and activation of individual strips proportionately activates a corresponding pixel, then activation of the pixel can be made in discrete steps of intensity from 0 to 32 to thereby produce a grey scale. For example, if a pixel intensity of 19 is desired, the strips sized 16, 2 and 1 need to be activated.

From the above, it is apparent that the present invention is the first to provide a flat panel display comprising 1) a cathode assembly having a plurality of cathodes, each cathode including a layer of cathode conductive material and a layer of a low effective work-function material deposited over the cathode conductive material and 2) an anode assembly having a plurality of anodes, each anode including a layer of anode conductive material and a layer of cathodoluminescent material deposited over the anode conductive material, the anode assembly located proximate the cathode assembly to thereby receive charged particle emissions from the cathode assembly, the cathodoluminescent material emitting light in response to the charged particle emissions.

Although the present invention and its advantages have been described in detail, it should be understood that various changes, substitutions and alterations can be made herein without departing from the spirit and scope of the invention as defined by the appended claims.

What is claimed is:

1. A diode flat panel display consisting of only anode and cathode electrodes, comprising:

a plurality of corresponding light-emitting anodes and field-emission cathodes, each of said anodes emitting light in response to emission from each of said corresponding cathodes; and means for addressing and electrically exciting selectable ones of said corresponding anodes and cathodes by changing an electrical potential of both said corresponding cathode and anode.

2. The display as recited in claim 1 wherein said cathodes are divided into cathode subdivisions.

3. The display as recited in claim 1 wherein said anodes are divided into anode subdivisions.

4. The display as recited in claim 2 wherein each cathode subdivision is independently addressable.

5. The display as recited in claim 3 wherein each anode subdivision is independently addressable.

6. The display as recited in claim 4 wherein said cathode subdivisions are addressable in various combinations to allow a grey scale operation of said cathodes.

7. The display as recited in claim 5 wherein said anode subdivisions are addressable in various combinations to allow a grey scale operation of said anodes.

8. The display as recited in claim 6 wherein said cathode subdivisions are of various sizes.

9. The display as recited in claim 7 wherein said anode subdivisions are of various sizes.

10. The display as recited in claim 8 wherein said sizes of said cathode subdivisions are related to one another by powers of 2.

11. The display as recited in claim 9 wherein said sizes of said anode subdivisions are related to one another by powers of 2.

12. The display as recited in claim 1 wherein said plurality of anodes comprise phosphor strips.

13. The display as recited in claim 1 wherein each of said cathodes comprises:

a substrate;

an electrically resistive layer deposited over said substrate; and a layer of material having a low effective work function deposited over said resistive layer.

14. The display as recited in claim 1 wherein an electrical potential provided by a diode biasing circuit is continuously applied to said corresponding anodes and cathodes.

15. The display as recited in claim 14 wherein said corresponding cathode and anode pair is electrically activated in response to application of a total electrical potential equal to a sum of said electrical potential provided by said diode biasing circuit and an electrical potential provided by a driver circuit.

16. The display as recited in claim 15 wherein said electrical potential provided by said driver circuit is substantially less than said electrical potential provided by said diode biasing circuit.

17. A method of operation of a diode flat panel display consisting of only anode and cathode electrodes, comprising the steps of:

providing a plurality of corresponding light-emitting anodes and field-emission cathodes, each of said anodes emitting light in response to emission from each of said corresponding cathodes; and addressing and electrically exciting selectable ones of said corresponding anodes and cathodes by changing an electrical potential of both said corresponding cathode and anode.

18. The method as recited in claim 17 wherein said cathodes are divided into cathode subdivisions.

19. The method as recited in claim 17 wherein said anodes are divided into anode subdivisions.

20. The method as recited in claim 18 wherein each cathode subdivision is independently addressable.

21. The method as recited in claim 19 wherein each anode subdivision is independently addressable.

22. The method as recited in claim 20 wherein said cathode subdivisions are addressable in various combinations to allow a grey scale operation of said cathodes.

23. The method as recited in claim 21 wherein said anode subdivisions are addressable in various combinations to allow a grey scale operation of said anodes.

24. The method as recited in claim 22 wherein said cathode subdivisions are of various sizes.

25. The method as recited in claim 23 wherein said anode subdivisions are of various sizes.

26. The method as recited in claim 24 wherein said sizes of said cathode subdivisions are related to one another by powers of 2.

27. The method as recited in claim 25 wherein said sizes of said anode subdivisions are related to one another by powers of 2.

28. The method as recited in claim 17 wherein said plurality of anodes comprise phosphor strips.

29. The method as recited in claim 17 wherein each of said cathodes comprises:

a substrate;

an electronically resistive layer deposited over said substrate; and a layer of material having a low effective work function deposited over said resistive layer.

30. The method as recited in claim 17 wherein an electrical potential provided by a diode biasing circuit is continuously applied to said corresponding anodes and cathodes.

31. The method as recited in claim 30 wherein said corresponding cathode and anode pair is electrically activated in response to application of a total electrical potential equal to a sum of said electrical potential provided by said diode biasing circuit and an electrical potential provided by a driver circuit.

32. The method as recited in claim 31 wherein said electrical potential provided by said driver circuit is substantially less than said electrical potential provided by said diode biasing circuit.

33. A system for implementing a grey scale in a diode flat panel display consisting of only anode and cathode electrodes, said system comprising:

a plurality of field emission cathodes arranged in rows;

a plurality of light emitting anodes arranged in columns, each column subdivided into sub-columns, said anodes responsive to electrons emitted from said cathodes;

means for joining said rows of cathodes and said columns of anodes to form a pattern of pixels; and means for independently and simultaneously addressing a cathode row and a combination of anode subcolumns within an anode column to thereby produce various levels of pixel intensity.

34. The system as recited in claim 33 wherein said subcolumns are of varying widths.

35. The system as recited in claim 33 wherein said anode comprises a phosphor.

36. The system as recited in claim 33 wherein said field emission cathode comprises:

a substrate;

an electronically resistive layer deposited over said substrate; and a layer of material having a low effective work function deposited over said resistive layer.

37. The system as recited in claim 36 wherein said material has a low effective work function.

38. The system as recited in claim 33 wherein said rows of cathodes and said columns of anodes are separated by a physical gap and an electrical potential provided by a diode biasing circuit.

39. The system as recited in claim 38 wherein said subcolumns of anodes are activated by said rows of cathodes in response to a total electrical potential equal to a sum of said electrical potential provided by said diode biasing circuit and an electrical potential provided by a driver circuit.

40. The system as recited in claim 39 wherein said electrical potential provided by said driver circuit is substantially less than said electrical potential provided by said diode biasing circuit.

41. The system as recited in claim 33 wherein said various levels of intensity are discrete levels.

42. A diode flat panel display consisting of only anode and cathode electrodes, comprising:

a plurality of corresponding light-emitting anodes and field-emission cathodes, each of said anodes emitting light in response to emission from each of said corresponding cathodes; and means for selectively varying field emission between said plurality of corresponding light-emitting anodes and field-emission cathodes to thereby effect an addressable grey-scale operation of said flat panel display.

43. The display as recited in claim 42 wherein emission between said plurality of corresponding light-emitting anodes and field-emission cathodes is varied by application of a variable electrical potential between selectable ones of said plurality of corresponding light-emitting anodes and field-emission cathodes.

44. The display as recited in claim 42 wherein emission between said plurality of corresponding light-emitting anodes and field-emission cathodes is varied by applying a switched constant electrical potential between selectable ones of said plurality of corresponding light-emitting anodes and field-emission cathodes.

45. The display as recited in claim 44 wherein said constant electrical potential is pulse width modulated.

46. The display as recited in claim 1 wherein each of said cathodes comprises:

two conductive layers having different resistivities, wherein a lower one of said two conductive layers has a higher conductivity than an upper one of said two conductive layers.

47. A diode flat panel display consisting of only anode and cathode electrodes, comprising:

a plurality of corresponding light-emitting anodes and field emission cathodes, each of said anodes emitting light in response to emission from each of said corresponding cathodes, wherein each of said cathodes comprises:

a substrate;

an electrically resistive layer deposited over said substrate; and a conductive material deposited over said resistive layer.

* * * * *